United States Patent [19]

Minovitch

[11] Patent Number: 4,939,976

[45] Date of Patent: Jul. 10, 1990

[54] ELECTROMAGNETIC GROUND TO ORBIT PROPULSION METHOD AND OPERATING SYSTEM FOR HIGH MASS PAYLOADS

[76] Inventor: Michael A. Minovitch, 2832 St. George St. #6, Los Angeles, Calif. 90027

[21] Appl. No.: 176,679

[22] Filed: Apr. 1, 1988

[51] Int. Cl.[5] ..... F41F 1/02

[52] U.S. Cl. ..... 89/8; 124/3; 244/63; 310/13; 505/896

[58] Field of Search ..... 89/8; 124/3; 244/36, 244/62, 63; 310/13; 505/876

[56] References Cited

U.S. PATENT DOCUMENTS

| | | | |
|---|---|---|---|
| 3,825,211 | 7/1979 | Minovitch | 244/62 |
| 4,078,747 | 3/1978 | Minovitch | 174/125.1 |
| 4,432,333 | 2/1984 | Kurherr | 89/8 |

FOREIGN PATENT DOCUMENTS

| | | | |
|---|---|---|---|
| 3426452 | 1/1986 | Fed. Rep. of Germany | 89/8 |
| 2479138 | 10/1981 | France | 244/63 |

OTHER PUBLICATIONS

Jones, L. W. and Keefer, D. R., "NASA's Laser Propulsion Project", *Astronautics & Aeronautics,* Sep. 1982, pp. 66–73.

Korthal-Altres, S. W., "Will the Aerospace Plane Work", *Technology Review,* Jan. 1987, pp. 42–51.

Jones, R. A. and Donaldson, C. D., "From Earth to Orbit in a Single Stage", *Aerospace America,* Aug. 1987, pp. 32–34.

Kolm, H., "Electromagnetic Launchers", *IEEE Transactions on Magnetics,* vol. MAG-16, No. 5, Sep. 1980, pp. 719–721.

Minovitch, M. A., "The Laser Rocket—A Rocket Engine Design Concept for Achieving a High Exhaust Thrust with High Isp", JPL, TM 393-92, Feb. 18, 1972.

Minovitch, M. A., "Generalized Theory of Rocket Propulsion for Future Space Travel", *Journal of Propulsion and Power,* vol. 3, No. 4, Jul.-Aug. 1987.

DeMario, W. F., "New World for Aerospace Composites", *Aerospace America,* Oct. 1985, pp. 36–42.

Bohn, E. V., *Introduction to Electromagnetic Fields and Waves,* Addison-Wesley Pub. Co., 1968, pp. 219–220.

Glashow, S. and Lederman, L. M., "The SSC: A Machine for the Nineties", *Physics Today,* Mar. 1985, pp. 28–37.

Pike, G. E. et al., "Superconducting Properties of Thin Film Niobium Carbonitrides on Carbon Fibers", *IEEE Transactions on Magnetics,* vol. MAG-11, No. 2, Mar. 1975, pp. 185–188.

Khurana, A., "High $T_c$ May Not Need Phonons; Supercurrents Increase", *Physics Today,* Jul. 1987, pp. 17–21.

(List continued on next page.)

*Primary Examiner*—Stephen C. Bentley

*Attorney, Agent, or Firm*—Christie, Parker & Hale

[57] ABSTRACT

A reusable and regenerative electromagnetic propulsion method and operating system is provided for propelling high mass payloads to orbital velocities which does not require a vacuum environment. The propulsion system comprises a self supporting superconducting dipole coil several kilometers in diameter that is accelerated by magnetic repulsive forces generated by a plurality of giant superconducting field coils mounted in underground tunnels. The propulsion dipole is mounted inside a circular hypersonic wing-like structure equipped with movable aerodynamic control surfaces for guidance. The propulsion system can accelerate a payload with any desired launch azimuth by accelerating along a line of magnetic induction generated by the field coils having the desired azimuth angle. The payload is attached to the propulsion system by a plurality of cables. After reaching orbital velocity, the payload is detached from the propulsion system and the propulsion system is decelerated back to the earth's surface by magnetic repulsive forces generated by the field coils. A large fraction of the orbital energy of the propulsion system is reconverted back into electrical energy by the inductive coupling between the magnetically decelerated propulsion coil and the field coils which is used to launch another payload.

18 Claims, 12 Drawing Sheets

OTHER PUBLICATIONS

Fisher, A., "Superconductor Frenzy", *Popular Science,* Jul. 1987, pp. 54–97.

Gilman, J. J., "The Commercial Potential of High-$T_c$ Superconductors", *Physics Today,* Mar. 1988, pp. 85–87.

Hamakawa, Y., "Photovoltaic Power", *Scientific American,* Apr. 1987, pp. 87–92.

Boom, R. W., "Superconductive Energy Storage for Diurnal Use by Electric Utilities", *IEEE Transactions on Magnetics,* vol. MAG-17, No. 1, Jan., 1981.

Kolm, H. and Mongeau, P., "Basic Principles of Coaxial Launch Technology", *IEEE Transactions on Magnetics,* vol. MAG-20, No. 2, Mar. 1984, pp. 227–230.

Kolm, H. and Mongeau, P., "An Alternative Launching Medium", *IEEE Spectrum,* Apr. 1982, pp. 30–36.

Martin, A. R., "Magnetic Intake Limitations on Interstellar Ramjets", *Astronautica Acta,* vol. 18, 1973, pp. 1–10.

O'Neill, G., "The Colonization of Space", *Physics Today,* vol. 27, Sep. 1974, pp. 32–40.

Minovitch, M. A., "Gravity Thrust and Interplanetary Transportation Networks", *Use of Space Systems for Planetary Geology and Geophysics,* AAS vol. 17, 1968.

Gleick, James, "Discoveries Bring a 'Woodstock for Physics'", New York Times, Mar. 20, 1987.

Salkeld et al., "A Reusable Space Vehicle for Direct Descent from High Orbits", AIAA, Apr. 1981, pp. 46–47, 63.

10
20
18
14
22
28
24
16
26
12
28
14

10
18
30
24
22
28
32
34
12
14

GROUND FIELD (GAUSS)
200
150
100
50
100
200
300
400
500
600
DISTANCE (KM)

SPACE FIELD (GAUSS)
40
30
20
10
200
400
600
800
1000
1200
ALTITUDE (KM)

ACCELERATION (G)
20
15
10
5
50
100
150
200
250
300
ALTITUDE (KM)

ACCELERATION (G)
80
60
40
20
50
100
150
200
250
300
ALTITUDE (KM)

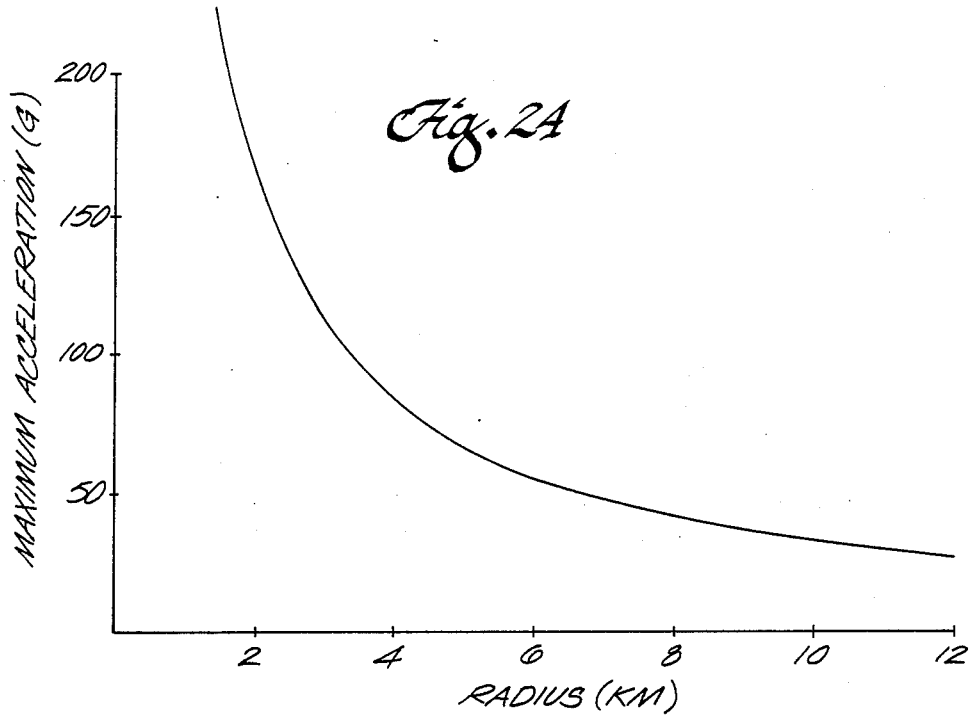
Fig. 25
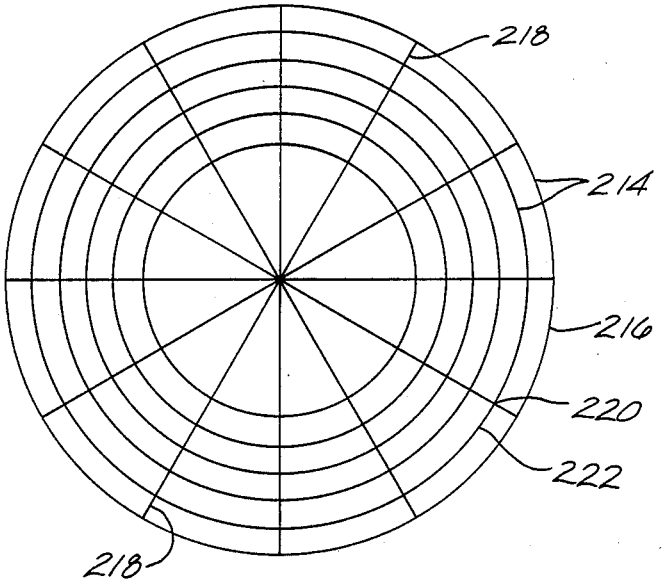

ELECTROMAGNETIC GROUND TO ORBIT PROPULSION METHOD AND OPERATING SYSTEM FOR HIGH MASS PAYLOADS

BACKGROUND

The last frontier where mankind can explore, utilize and eventually colonize is outer space. The deciding factor that will determine how fast and to what extent mankind will advance into and develop this new frontier ultimately depends upon how expensive it is to get there. The reusable ground to orbit shuttle vehicle represents a considerable advance toward developing an economical space transportation system. Before this system was developed, launch vehicles were expendable. Consequently, the cost of transporting passengers and/or bulk cargo to earth orbit with those first generation launch vehicles was enormous. Thus, the development of reusable launch vehicles represented an important step in reducing the cost of transporting payloads to earth orbit.

Although designs are currently being advanced to develop more economical reusable ground to orbit space shuttles, there is one fundamental problem that appears to be insolvable. This problem can be called the "initial mass problem" and is inherent in all space vehicles propelled by chemical rocket engines. This problem can best be described by considering the well known "rocket equation".

$$\frac{M_1}{M_2} = \exp(\Delta V/u) \tag{1}$$

In this equation $M_1$ and $M_2$ represent a rocket vehicle's total mass before and after burning its engine to achieve a velocity change denoted by $\Delta V$. The engine's exhaust velocity is denoted by u. The ratio of initial mass to final mass represented by $M_1/M_2$ is called the "mass ratio". Thus, the amount of fuel $M_f$ required to achieve a velocity change $\Delta V$ is given by $M_f = M_1 - M_2$. The initial mass $M_1$ can be calculated by multiplying the mass ratio by the vehicle's final mass $M_2$. Consequently, in order to keep the vehicle's initial mass $M_1$ (and required fuel load $M_f$) as low as possible, the mass ratio should be kept as low as possible. For any given $\Delta V$, it follows from equation (1) that the mass ratio can be reduced only by increasing the exhaust velocity u. Unfortunately, chemical rocket engines have a definite upper limit on u that cannot be exceeded because of fundamental thermodynamics. This upper limit is about 4.50 km/sec. Since the minimum $\Delta V$ required to reach low earth orbit when aerodynamic drag and gravity losses are taken into consideration is about 9.00 km/sec, the lowest possible mass ratio corresponding to this $\Delta V$ for single stage launch vehicles is 7.39.

In order to illustrate the effect of the initial mass problem suppose that the final "dry mass" $M_2$ of a single stage ground to orbit chemically propelled launch vehicle is 100,000 kg. Since the minimum mass ratio required to achieve Earth orbit is 7.39, the minimum required initial mass $M_1$ would have to be 739,000 kg, and the required fuel load would be 639,000 kg. Construction experience has shown that the minimum structural mass required for a cryogenic fuel tan is about 10% of the maximum fuel load. Thus, the mass of the fuel tank alone would be about 63,900 kg. This only leaves about 36,100 kg for the remaining structural mass of the vehicle including the payload. These calculations clearly illustrate that it requires a truly enormous launch vehicle, with an enormous fuel load, to orbit even a relatively low mass payload. The initial mass of the U.S. Space Shuttle is over 2,222,000 kg but the maximum payload is only 30,000 kg. Thus, the payload-to-initial launch mass ratio required to achieve earth orbit by the most efficient single stage chemical launch vehicle is about 70. This is the initial mass problem inherent in all rocket vehicles propelled by chemical rocket engines. Of course, staging does alleviate this problem but when completely reusable launch vehicle designs are contemplated, staging does not offer any significant advantage in terms of reducing overall operational costs. (The U.S. Space Shuttle is considered to be a one and one-half stage vehicle.)

Engineers have studied the initial mass problem for many decades. Since the crux of the problem involves the inherently low exhaust velocities of chemical rocket engines, attempts have been made to develop entirely new engines. But the problem is not simply to develop an engine capable of generating higher exhaust velocities. The engines suitable for launch vehicles must be capable of generating very high thrust to weight ratios. For example, the total thrust developed by a launch vehicle that is launched in the conventional vertical attitude must obviously be greater than the total initial weight of the vehicle if it is to climb off the launch pad.

Ion engines have very high exhaust velocities but have absolute upper bounds on their thrust to weight ratios which are small fractions of unity. Thus, they are unsuitable for launch vehicles. Nuclear rocket engines are capable of generating fairly high thrust to weight ratios but the danger of crashing and contaminating a large area of the earth's surface with radioactivity renders such engines impractical for launch vehicles.

Other, more exotic rocket engines, have been proposed for launch vehicles such as laser rocket engines. In these engines, a high power laser beam is directed at the launch vehicle which is captured and focused onto a suitable working fluid. The working fluid is thereby heated to very high temperatures and expelled from the vehicle with exhaust velocities significantly higher than those obtainable with chemical rocket engines. (See "NASA'S Laser Propulsion Project," *Astronautics & Aeronautics,* Sept. 1982, pp. 66–73 by L. W. Jones and D. R. Keefer.) Unfortunately, the amount of power that must be generated and focused onto a relatively small area in order to accelerate high mass manned vehicles to orbital velocities renders such concepts impractical. (However, these concepts may be useful for launching relatively small unmanned payloads with very high acceleration.)

The scramjet represents another propulsion system designed to circumvent the initial mass problem. Basically, this engine ingests atmospheric air while the vehicle is moving at relatively low altitudes, and sprays it with hydrogen gas which ignites inside the engine forcing the combustion gases to leave the engine faster than the incoming air thereby generating propulsive thrust. Only hydrogen fuel can be used in this engine because of the very short ignition time. Unfortunately, liquefied hydrogen has a very low density which requires fuel tanks five times larger than conventional fuel tanks (which must be thermally insulated since liquefied hydrogen is a very low temperature cryogenic fluid). This results in a high inert structural mass with a corresponding decrease in payload mass. See "Will the Aerospace Plane Work," *Technology Review*, January 1987, pp. 42–51 by S. W. Korthals-Altres. This problem is compounded by the fact that since the kinetic energy that the vehicle must develop in order to reach orbital velocity is so high ($4\times10^9$Joules/kg) the amount of hydrogen fuel that must be carried by the vehicle to achieve orbital velocity is about 56% of the total initial vehicle mass, even assuming optimal combustion efficiency. See "From Earth To Orbit In A Single Stage," *Aerospace America*, August 1987, pp. 32–34, by R. A. Jones and C. D. Donaldson. Thus, there are inherent fundamental engineering problems with this propulsion concept that cannot be circumvented even if the scramjet propulsion system can be made to operate as envisioned at orbital velocity (which may be a physical impossibility). The initial mass problem can be reduced somewhat by this propulsion concept, but it will still be there. Moreover, another problem will be introduced involving a severe limitation on payload volume because nearly all of the interior volume of the vehicle will have to be filled with liquefied hydrogen.

Since the scramjet propelled reusable aerospace plane is currently believed to represent the cheapest method for achieving orbit (with an estimated cost of $200/lb compared to $2,000/lb for the Space Shuttle) the prospects for commercial space travel by private individuals in the 21st century appears to be very remote. (For example, it would cost a 200 lb passenger without luggage $40,000 to be transported to orbit on a one-way flight with this vehicle.)

In theory, the most efficient method for propelling payloads into orbit is by means of an electromagnetic accelerator because the cost essentially reduces to the cost of generating an amount of electrical energy equal to the kinetic and potential energy of the total mass that is accelerated to orbit. For example, if the cost of generating electrical energy is 10¢/KW-hr, this cost is 90¢/kg or 41¢/lb for a 200 km high circular orbit. This is 5,000 times cheaper than the U.S. Space Shuttle and about 500 times cheaper than the proposed aerospace plane. Although there are several different types of electromagnetic accelerators (which are also called mass drivers) that have been designed to accelerate bodies to high velocities (i.e., orbital velocities) from the earth's surface, they all have one common characteristic: they all require an evacuated launch tube through which the payload is accelerated. Therefore, unless an evacuated tube of several hundred kilometers is provided, the acceleration of prior art electromagnetic ground to orbit launchers are inherently high, and the mass and physical dimensions of the payload are too small to be of any significant practical value. See "Electromagnetic Launchers," *IEEE Transactions On Magnetics*, Vol. MAG-16, No. 5, Sept. 1980, pp. 719–721 by H. Kolm et al.

Large objects, such as completely assembled space based interplanetary transfer vehicles (ITVs) with diameters exceeding 25 m and lengths exceeding 100 m would be completely impossible to accelerate to orbit from the earth's surface by any prior art electromagnetic accelerator. In fact, completely assembled payloads with these dimensions could not be accelerated into orbit by any prior art ground to orbit transportation system (or any such system proposed for the future) because they would simply be too large. It is assumed without question and taken for granted that large objects designed for operating in earth orbit will have to be transported there piece by piece, in relatively small sections, and assembled in orbit. The idea of transporting such huge objects as completely assembled ITVs or completely assembled space stations is viewed as so ridiculous in the prior art of astronautics that such possibilities are not even described in science fiction novels.

The size and weight limitations on payloads transportable to earth orbit in current or future launch vehicles is rooted in the basic thrust generating principles used for accelerating payloads to orbit which, for all practical purposes, are believed to be essentially unchangeable because they involve basic laws of physics. However, the discovery of a fundamentally new physical phenomenon or principle could be applied to develop a completely new thrust generating propulsion concept. An example of this type of innovation was the invention of laser heated rocket propulsion where the phenomena of coherent light generation and propagation represented by laser beams was applied to the field of rocket propulsion. See "The Laser Rocket—A Rocket Engine Design Concept For Achieving A High Exhaust Thrust With High Isp," Jet Propulsion Laboratory, TM 393–92, Feb. 18, 1972, by M. Minovitch, and "Laser Rocket," U.S. Pat. No. 3,825,211 filed June 19, 1972, M. Minovitch.

The ground-to-orbit propulsion concept disclosed herein is based upon another such discovery—superconducting materials with high critical temperatures. It will be shown that this propulsion concept will enable payloads to be orbited with mass and physical dimensions far beyond that which were previously believed to be possible. In fact, for all practical purposes, there are no limits on the size and mass of payloads that could be transported to orbit with this propulsion system. Moreover, since this propulsion concept is basically electromagnetic, it also enables the payloads to be transported to orbit with minimum cost. It will be easily capable of transporting to orbit completely assembled reusable space-based interorbital/interplanetary transfer vehicles operating under the generalized theory of rocket propulsion. (See, "Generalized Theory of Rocket Propulsion for Future Space Travel," *Journal of Propulsion and Power*, Vol. 3, No. 4, July-August 1987, pp. 320–328, by M. Minovitch.)

Providing the technical means for transporting such huge fully assembled vehicles, and other huge objects such as completely assembled manned space stations hundreds of meters in diameter with a mass of thousands of tons, from the earth's surface directly into orbit (previously believed to be a physical impossibility) is a primary object of this invention.

BRIEF DESCRIPTION OF THE INVENTION

With the foregoing in mind, the present invention provides a reusable and regenerative automated propulsion system for accelerating high mass payloads with very large dimensions from the earth's surface directly to orbit. The propulsion system comprises a self supporting superconducting dipole coil with very high aspect ratio that is accelerated by magnetic repulsive forces generated by a plurality of giant superconducting field coils mounted coaxially in circular underground tunnels located in a remote region. All of the superconducting coils are constructed with superconducting material having a critical temperature above liquid nitrogen thereby eliminating the need for liquefied helium cryogenic refrigeration systems. The propulsion system, along with the attached payload, is launched vertically and accelerated along a line of magnetic induction generated by the field coils. The propulsion system can accelerate the payload with any desired launch azimuth by accelerating along a line of magnetic induction that has the desired azimuth angle.

The propulsion coil is mounted inside a circular hypersonic wing-like structure equipped with movable aerodynamic control surfaces for guidance. The surfaces are moved by a plurality of electric servo motors controlled by a high accuracy inertial guidance system. The propulsion coil is constructed with a plurality of individual superconducting loops with superconducting switching circuits that enable the current flowing around the loops to be reversed. This switching system enables the magnetic field of the coil to be increased or decreased thereby providing a means for varying the propulsive thrust. The guidance system controls the propulsive thrust of the coil by controlling the switching circuits. The propulsion system can also be controlled from the ground, or from an orbiting satellite via radio signals. The payload is mounted inside a protective shroud and attached to the propulsion system by a plurality of cables.

After the payload is inserted into orbit, it is detached from the propulsion system, and the propulsion system is decelerated back to the earth's surface by magnetic repulsive forces generated by the same field coils. A large fraction of the kinetic and potential energy of the orbiting propulsion system is reconverted back into electrical energy by the inductive coupling between the magnetically decelerated propulsion coil and the field coils which is used to launch another payload.

By utilizing the favorable scaling laws of electromagnetism, it is possible to launch giant sized payloads exceeding $10^7$ kg using propulsion coils extending to a diameter of several kilometers. By constructing the field coils with a diameter approximately equal to orbital altitude, it is possible to achieve orbital velocities with relatively low acceleration thereby allowing the system to be used for transporting manned payloads. (Thousands of passengers could be transported to orbit in a single flight.)

Since the magnetic field strength directly over the coils at orbital altitudes is inversely proportional to the cube of the altitude, the field at orbital altitudes directly over the coils is relatively weak and decreases very rapidly with increasing altitude. At an altitude of 500 km, the field is negligibly small over the coils so that orbiting satellites will not be affected by the system. Likewise, the magnetic field generated by the coils on the earth's surface in a region surrounding the outer perimeter of the coils (in the plane of the coils) decreases even more rapidly with distance. Thus, the magnetic fields generated by the coils resulting from fundamental principles of electromagnetism are ideally suited for the propulsion concept proposed herein because these fields are sufficiently strong locally to generate enormous propulsive thrust, but decrease very rapidly with increasing distance so as to not affect the surrounding region at any significant distance.

A system of annular arrays of photovoltaic solar cells are mounted between adjacent field coils for generating electrical energy. This electrical energy is used for initially charging up the superconducting field coils and maintaining them with a desired inductive energy. The amount of inductive energy in the fully charged field coils is several orders of magnitude greater than the amount of energy used to launch a payload. Thus, the system will enable multiple launches to take place nearly simultaneously with massive payloads without any significant decrease in the magnetic field. By constructing large solar arrays with diameters of many kilometers, the system will generate significantly more electrical energy than is used for launching payloads. Thus, the cost of the electrical energy used in launching payloads is zero and the excess electrical energy generated by the arrays can be sold to utility companies for generating income revenue that is significantly greater than the total cost of operating the system.

A large fleet of automated magnetic propulsion systems can be provided using the same field coils ranging in size from a few dozen meters in diameter for accelerating small payloads of a few hundred kilograms, to several kilometers in diameter for accelerating high mass payloads of several thousand tons. By constructing the propulsion coils with very high aspect ratios, it is possible to obtain thrust to weight ratios of several hundred. The concept is envisioned as a vast complex with an outer diameter exceeding 300 km and an inner launching/landing area 50 km in diameter for providing very low cost transportation to orbit for private individuals, corporations or governments. It is also envisioned as a giant electric power generating plant.

DRAWINGS

These and other advantages and features of the invention will be apparent from the disclosure, which includes the specification with the foregoing and ongoing description, the claims, and the accompanying drawings wherein:

FIG. 24 is a graph of maximum possible acceleration versus coil radius; and

FIG. 25 is a schematic plan view of a magnetic propulsion system comprising a plurality of propulsion dipoles corresponding to an alternative embodiment of the invention.

DESCRIPTION OF THE PREFERRED EMBODIMENT

Figure 1:
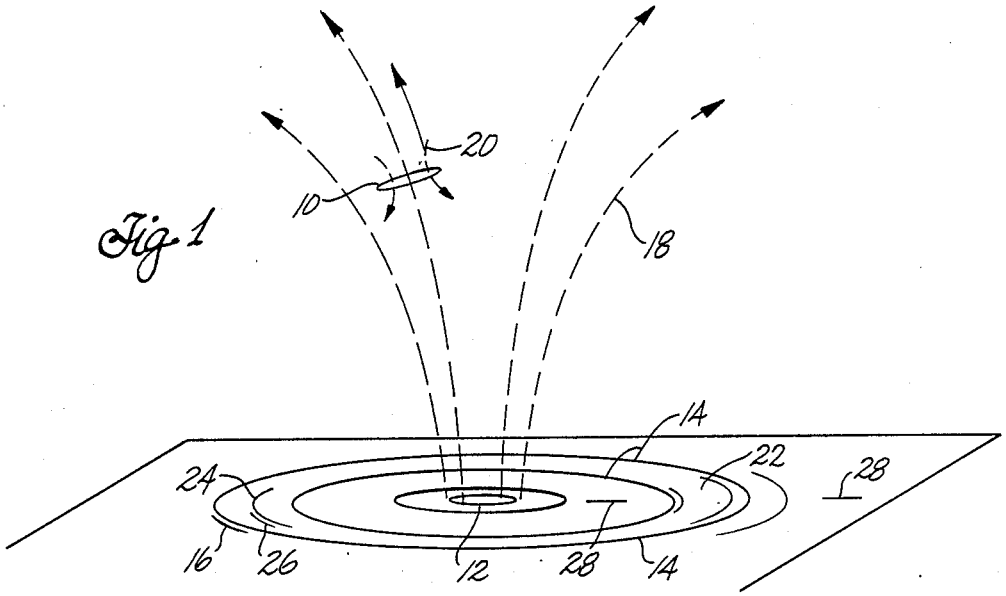
FIG. 1 is a schematic perspective view showing a superconducting propulsion dipole accelerating away from a plurality of coaxial field coils buried beneath the earth's surface illustrating the magnetic propulsion concept used in accelerating the payload.

The ground to orbit propulsion system disclosed herein is based upon the recent discoveries of superconducting material with critical temperatures, critical fields, and current densities significantly greater than previously believed possible. This fundamentally important technological breakthrough enables current carrying superconductors to be operated at liquid nitrogen temperature without expensive liquefied helium cryogenic cooling systems. Since the superconducting material is relatively cheap, it can be mass produced in large quantities by automated factories thereby reducing its cost by the economics of scale. Thus, since liquefied helium cryogenic cooling systems are not required, it is possible to install superconducting coils inside thermally insulated circular underground tunnels with diameters of many kilometers to generate an enormous magnetic field extending many kilometers into space. This field can then be utilized to propel a smaller current carrying superconducting coil by magnetic repulsive forces over distances that approach orbital altitude with thrust to weight ratios exceeding 1.0. Since the amount of thrust generated by the coil is proportional to the square of its radius, it is possible to achieve levels of propulsive thrust far greater than any prior art propulsion system merely by increasing the size of the propulsion coil. In fact, there is virtually no limit on the amount of thrust that can be generated by this propulsion concept. The acceleration and ascent trajectory can be designed to enable the coil to achieve orbital velocities and deliver payloads of almost unlimited mass and size directly into orbit. By installing field coils with diameters approximately equal to low orbital altitude (300 km) it is possible to reduce the peak acceleration loads to about 7 g which is well within the acceleration limits for manned payloads.

An orbiting propulsion coil can also be decelerated by magnetic repulsive forces generated by the field coils and returned back to the launch site. The inductive coupling between the field coils and the magnetically decelerated propulsion coil enable nearly all of the potential and kinetic energy of the orbiting coil to be reconverted to electrical energy when the coil is returned back to the launch site. Thus, the cost of orbiting the payload is essentially equal to the cost of generating an amount of electrical energy equal to the kinetic and potential energy of the orbiting payload mass (and not the combined mass of the payload and propulsion system used to deliver the payload). Since this cost involves pure payload mass and not the combined mass of payload and delivery system as in prior art electromagnetic ground to orbit propulsion systems, the magnetically propelled reusable and regenerative system disclosed herein represents the absolute minimum cost of transporting payloads to orbit which could never be reduced. If the cost of generating the electrical energy is 10¢KW-hr, the cost of transporting a payload to a 200 km high circular orbit by this propulsion concept is 90¢/kg or 41¢/lb. This is about 5,000 times lower than the $2,000/lb cost for the Space Shuttle and 500 times lower than the projected cost for the aerospace plane.

Since the propulsion concept is not based on any reaction principle requiring the expulsion of inertial mass, it does not use any rocket propellant. Thus, all of the mass that leaves the earth goes into orbit. The system therefore not only represents a reduction in the initial mass problem inherent in all prior art launch vehicles, but a complete elimination of the initial mass problem because it does not use any propellant. It has no moving parts, generates no sound, emits no combustion products, yet is able to generate continuous propulsive thrust over hundreds of kilometers far greater than that of any prior art propulsion system. However, the propulsion concept disclosed herein is uniquely simple and is made possible by scaling up well known phenomena of electromagnetism by many orders of magnitude. The scaling up process is itself made realizable by the discovery of warm superconducting material.

Figure 2:
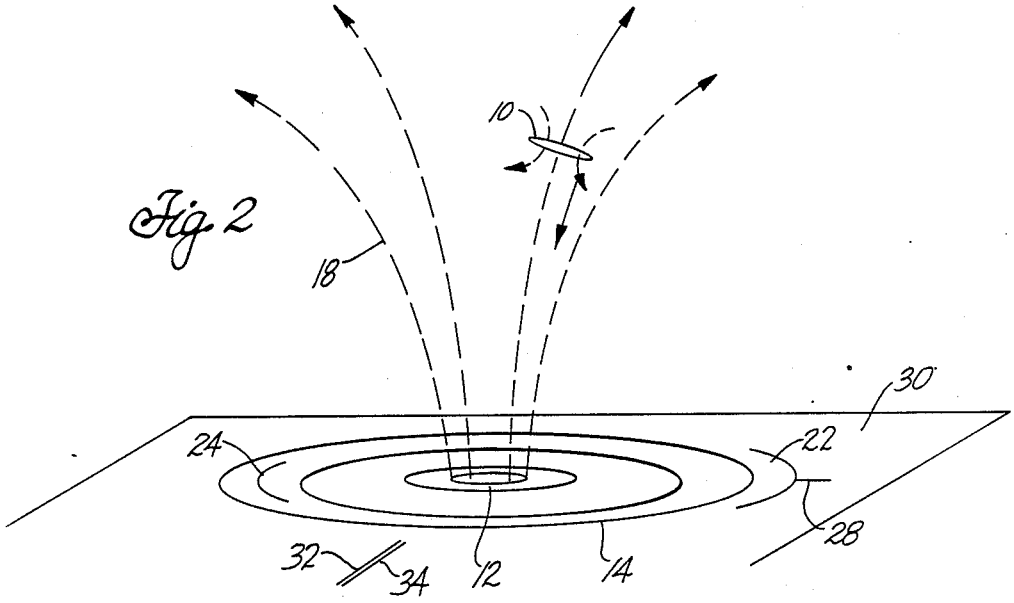
FIG. 2 is a schematic perspective view showing how a propulsion coil is magnetically decelerated from orbital velocity and returned to the launch site by an inductive coupling with the field coils thereby converting the potential and kinetic energy of the dipole back into electrical energy which is used to launch another payload.

The basic operating principles of the invention are illustrated in FIGS. 1 and 2. As is illustrated in FIG. 1, a propulsion coil 10, which is a self supporting superconducting dipole with very large aspect ratio, is accelerated vertically from an annular launching platform 12 by magnetic repulsive forces generated by a plurality of superconducting field coils 14, (which are also dipoles) mounted inside circular coaxial underground tunnels 16, in a remote region. These field coils 14 generate a resultant magnetic field 18 (represented by the vector summation or "superposition" of the individual magnetic fields) which opposes the magnetic field 20 generated by the propulsion dipole 10 which has opposite polarity. This results in a magnetic repulsive force exerted on the propulsion coil 10, and magnetic repulsive forces exerted on the field coils 14. Multiple arrays 22 of photovoltaic solar cells are mounted in annular regions between adjacent field coils 14 for generating electrical energy. A large underground magnetic energy storage system 24, comprising a plurality of independent superconducting shielded coils 26 is provided for accumulating electrical energy generated by the solar arrays 22. The field coils 14 are charged by electrical current generated by the solar arrays 22. A plurality of underground superconducting power transmission lines 28 are provided for transferring excess electrical energy not needed to operate the propulsion system to the national intertie power grid for distribution across the United States.

FIG. 2 is a schematic perspective view showing how a superconducting propulsion coil 10 is decelerated from orbital velocity by the stationary field coils 14 embedded beneath the earth's surface 30. The inductive coupling between the field coils 14 and the magnetically decelerated propulsion coil 10 enable nearly all of the potential and kinetic energy of the coil 10 to be reconverted into electrical energy when the coil 10 is brought to rest back on the launching platform 12. This electrical energy appears as an increase in the inductive energy of the field coils 14, and the propulsion coil 10, which is used to launch the next payload. Payloads are brought to the launch site via an underground access tunnel 32. The surrounding walls of this tunnel 32 are fitted with superconducting shielding coils 34 to prevent the magnetic field 18 generated by the field coils 14 from entering the access tunnel 32.

Figure 3:
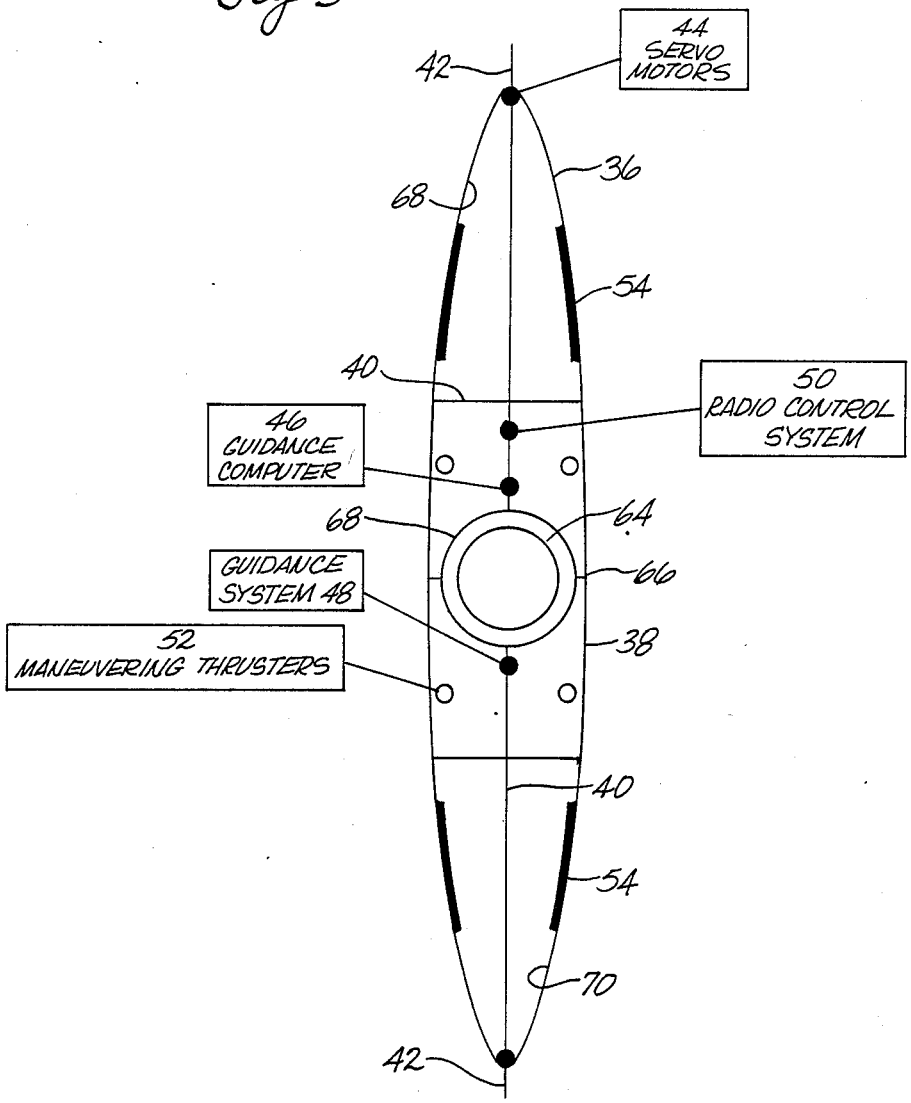
FIG. 3 is an enlarged transverse cross section through the minor axis of a propulsion coil illustrating the design and construction of a circular hypersonic wing-like airfoil mounted around the propulsion coil with movable aerodynamic control surfaces.

FIGS. 3. 4 and 5 describe the design and construction of the magnetic propulsion system 36. As is shown in these figures, the propulsion system 36 comprises a self supporting superconducting dipole coil 10 mounted inside a circular hypersonic wing-like airfoil 38. This airfoil 38 is attached to the coil 10 by a plurality of internal supporting struts 40. Some portions of the airfoil 38 are equipped with movable aerodynamic control surfaces 42 that enable the propulsion system 36 to be steered while traversing through the atmosphere at high velocity. The control surfaces 42 are moved by electrically driven servo motors 44 that are controlled by a guidance computer 46 and an inertial guidance system 48. A back-up radio control system 50 is provided to enable the control surfaces 42 to be controlled via radio signals transmitted from the launch site or from an orbiting satellite. When the propulsion system 36 is propelled by the magnetic repulsive forces generated by the field coils 14, the plane of the propulsion coil is automatically maintained in an attitude perpendicular to the magnetic field gradient of the field coils (i.e., perpendicular to the line of magnetic induction passing through the center of the propulsion coil generated by the field coils). This gives the propulsion system 36 a natural stability while it is magnetically accelerated or decelerated by the field coils 14. A plurality of small orbiting maneuvering thrusters 52 (which could be high pressure vessels of compressed gas) are also provided for generating small amounts of propulsive thrust while in orbit. These thrusters 52 are controlled by the guidance system 48 and can also be used for providing lateral guidance when the propulsion system 36 is moving at low velocities near the earth's surface. The airfoil 38 is also equipped with a plurality of high speed dive brakes 54 for providing additional decelerating propulsive thrust while traversing through the atmosphere during landing operations (or to reduce high accelerations through the atmosphere along the ascent trajectory). The dive brakes 54 are also controlled by the guidance system 48.

The propulsion coil 10 is constructed with a plurality of individual superconducting loops 56 with superconducting switching circuits 58 that enable the current flowing around the loops 56 to be reversed. This is accomplished by temporarily feeding the current into another loop and back into the original loop in a reverse direction. These switching circuits 58 enable some of the loops to have its current flowing in a direction opposite that of other loops. This will reduce the effective magnetic field (i.e., magnetic dipole moment) of the coil, which will result in a decrease in the propulsive thrust. The propulsive thrust will be maximum when the current flowing around all of the loops 56 is in the same direction. These switching circuits 58 therefore provide a means for controlling the propulsive thrust generated by the coil 10. The switching circuits 58 are controlled by the inertial guidance system 48 via a plurality of connecting wires 60. The coil 10 is wrapped with many layers of high strength KEYLAR, a trademark of E. I. Dupont de Nemours & Co., Wilmington, Del., fabric 62 to prevent individual loops from separating from the coil 10 by magnetic repulsive forces when their current is reversed. However, operationally, the current is reversed in those loops at, or near, the center of the coil so that they are prevented from moving away from the coil by the surrounding loops which exert an inward compressive force.

The airfoil 38 and the movable control surfaces 42 are constructed with high strength, high temperature composite material such as graphite fiber with negligible magnetic susceptibility. (See, "New World for Aerospace Composites," *Aerospace America,* Oct. 1985, pp. 36–42, by W. F. De Mario.) This protective aerodynamic hypersonic airfoil 38 gives the propulsion system 36 a fairly high lift to drag ratio which enables it to glide and maneuver a considerable distance through the atmosphere without any propulsive forces.

Figure 4:
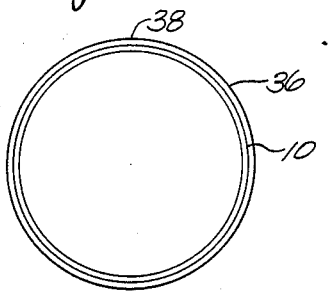
FIG. 4 is a perpendicular cross section of FIG. 3.
Figure 5:
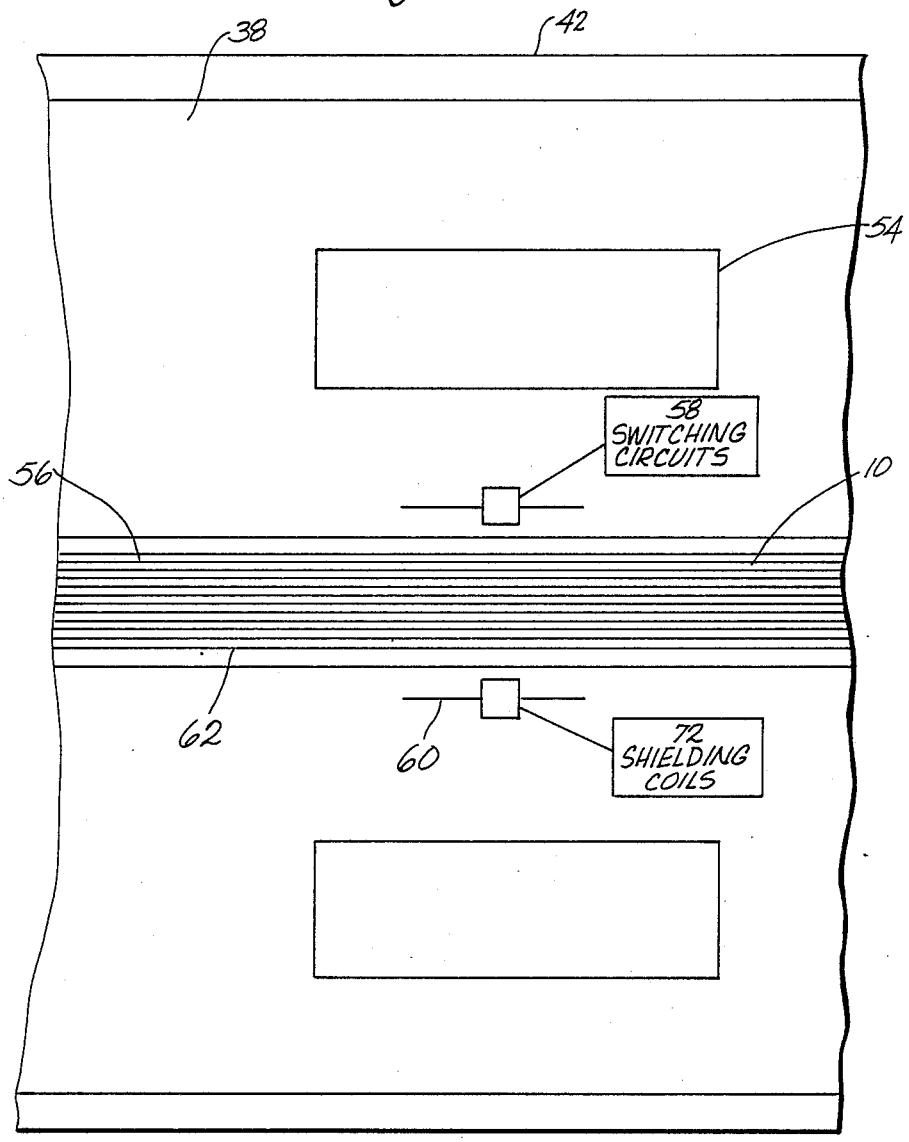
FIG. 5 is a vertical cross section of a portion of the airfoil further illustrating the design and construction.

As is shown in FIGS. 3, 4 and 5, the airfoil 38 is designed with a small transverse cross section with a chord to thickness ratio of about 8 to 1. This design enables the total structural mass of the airfoil 38, including all of its internal components except the dipole coil 10, to have a total mass approximately equal to 25% of the coil mass.

In order to enable the coil 10 to have a high thrust to weight ratio, the aspect ratio of the coil (which is equal to its major radius divided by its minor radius) is very high, exceeding for example 10,000. Consequently, the cross sectional diameter of the coil 10 is only a few centimeters even when the coil's major radius is thousands of meters. Thus, the transverse cross section of the hypersonic airfoil 38 as shown in FIG. 3 is only a few centimeters thick and about 1½ to 2 meters long. But it may have a circumference of 50 kilometers or more.

Although the superconductor inside the propulsion coil 10 is constructed with high temperature superconducting material, it is enclosed within a thermally insulated jacket 64 containing liquefied hydrogen 66 at about 20° K., which is maintained in direct thermal contact with the propulsion coil 10, thereby providing a cryogenic environment for the propulsion coil. This enables the superconducting material inside the coil to operate at very high current densities and high magnetic fields. Since the density of liquefied hydrogen is very low, this jacket 64 has relatively low mass. Thick blankets 68 of evacuated multilayer cryogenic thermal insulation are mounted around the outer walls of the jacket 64, and along the inside walls 70 of the airfoil 38. Essentially all of the structure surrounding the coil 10 is constructed with material having very low magnetic susceptibility. Small superconducting magnetic shielding coils 72 are provided to shield various electronic command and control systems from the magnetic field of the dipole 10.

Figure 6:
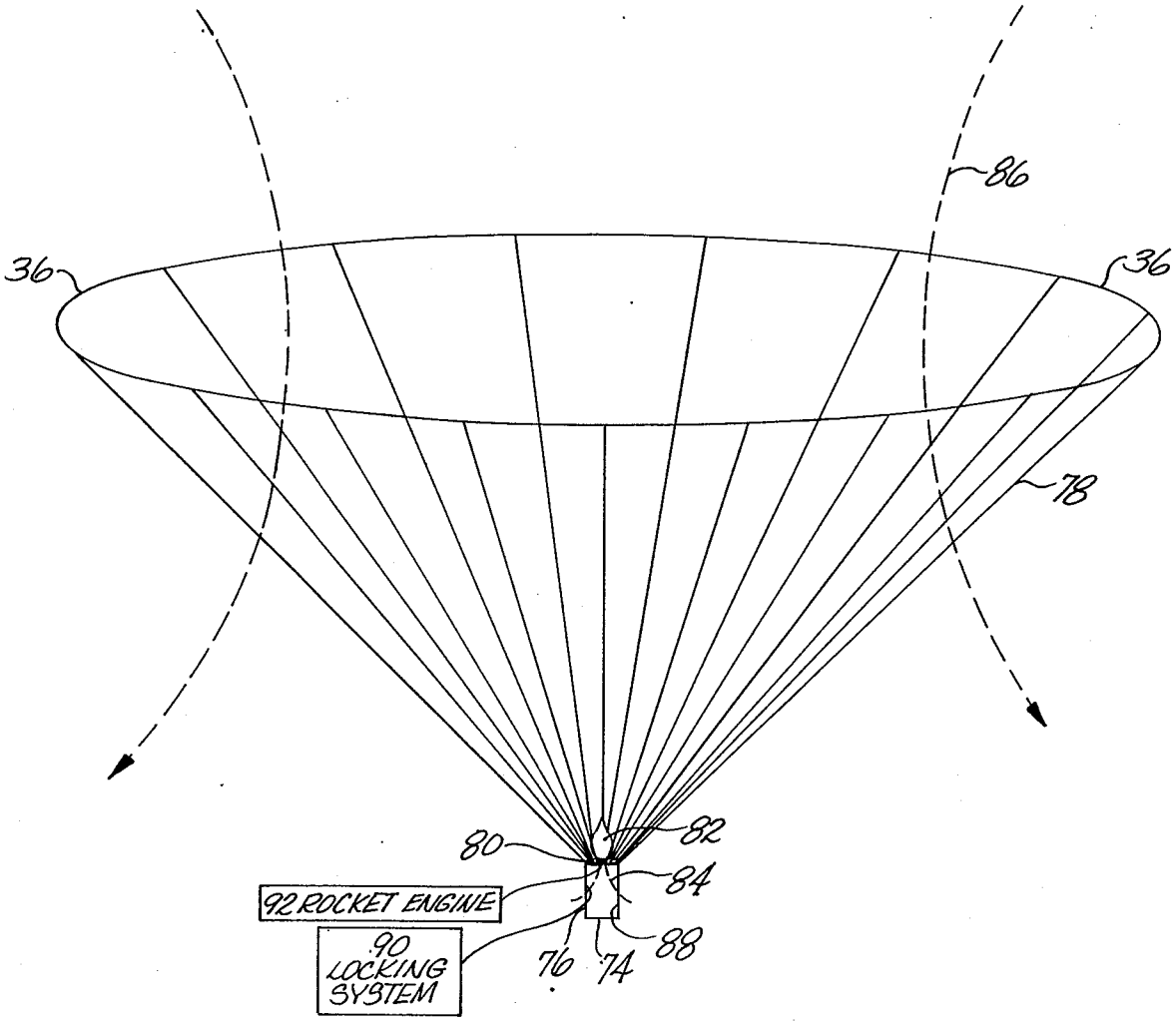
FIG. 6 is a schematic perspective view of the dipole propulsion system showing how a payload is attached by a plurality of connecting cables.

As is illustrated in FIG. 6 the payload 74 is mounted inside a protective shroud 76 that is attached to the propulsion system 36 by a plurality of cables 78. These cables are constructed with ultra high strength fused silica glass fibers with a tensile strength of $1.4\times10^{10}N/m^2$. The individual cables 78 are only a few millimeters thick but there are several hundred (or thousand) of them connected to the propulsion dipole (FIG. 3) with uniform and relatively close spacing so that the dipole will not be bent out of shape when generating high propulsive thrust.

The cables 78 are maintained under tension by a small secondary superconducting dipole 80 mounted inside a relatively small hypersonic bullet shaped aeroshell 82 that is connected to the cables 78. This secondary dipole 80 has a current flowing in the opposite direction from that flowing in the propulsion dipole 10 and thus exerts a magnetic repulsive force that keeps the cables 78 under tension even when the propulsion coil 10 is not being accelerated. The magnetic field 84 generated by the secondary dipole 80 is very small compared to the magnetic field 86 generated by the propulsion dipole 10. Hence, the propulsive thrust generated by the propulsion dipole 10 is not significantly reduced by the magnetic field 84 generated by the secondary dipole 80. The payload 74 is attached to the aeroshell 82 by a system of rigid beams 88 that can be automatically detached from the aeroshell 82 by an electrically operated locking system 90.

A relatively small conventional rocket propulsion system 92 is also mounted on the aeroshell 82. This system 92 is designed to generate a small retro propulsive force one-half of an orbit revolution before the propulsion system 36 is returned to the launch site. This is accomplished by lowering the perigee altitude of the orbiting coil by retro thrust such that when the coil approaches the field coils 14, approximately ½ orbit revolution after the retro maneuver, its altitude is about 150 km. This enables the propulsion system 36 to be magnetically decelerated back to the launch site.

The magnetic deceleration process converts the potential and kinetic energy of the propulsion dipole 10 into electrical energy (via the inductive coupling between the propulsion coil 10 and the field coils 14) which appears as an increase in the inductive energy of the field coils and the propulsion coil. This inductive energy is used to launch another payload. Additional current must be fed into the field coils and propulsion coil from the solar array in order to completely restore all the inductive energy used to launch the previous payload since the returning coil only enables that portion of the total inductive energy used to launch the propulsion coil (without the payload) to be returned to the field coils and propulsion coil. The cost of this additional inductive energy that must be added to the field coils and propulsion coil will be zero since the solar arrays are considered to be an integral part of the entire system.

Figure 7:
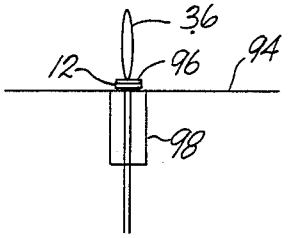
FIG. 7 is a schematic transverse cross section of a retractable annular launching/landing platform used by a propulsion dipole.

Just before the aeroshell 82 makes contact with the earth's surface 94, the magnetic field of the secondary dipole 80 is reduced to zero. This is accomplished by a current switching system similar to that used by the propulsion coil 10. Thus, as the altitude of the propulsion dipole slowly decreases (by controlling its magnetic field via the switching circuits) the aeroshell makes contact with the earth's surface 94 and the cables 78 also begin to make contact. The propulsion dipole gradually decreases its altitude (like a helicopter but in complete silence) and comes to rest on a relatively narrow annular platform 12 (FIG. 7) equipped with an air cushion surface 96. After the propulsion system 36 lands on the platform 12, the platform 12 retracts downward into an annular underground slot 98 that serves as an underground hanger for the propulsion system 36.

Figure 8:
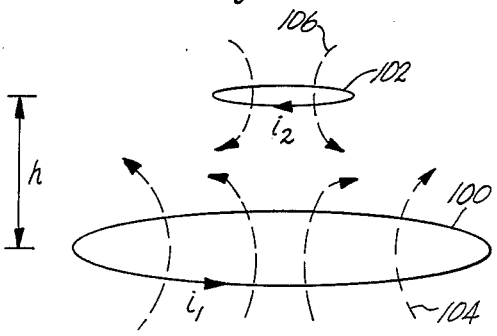
FIG. 8 is a schematic perspective view illustrating the magnetic repulsive force between two parallel coaxial current carrying coils.

In order to demonstrate the basic engineering feasibility of the proposed ground to orbit propulsion concept and operating system disclosed herein it is necessary to conduct a mathematical investigation. FIG. 8 illustrates two parallel coaxial circular coils 100, 102 with radii $R_1$ and $R_2$ separated by a distance h and carrying currents $i_1$ and $i_2$ in opposite directions respectively. Hence, the corresponding magnetic fields 104, 106 generated by the currents $i_1$ and $i_2$ have opposite directions, and the coils are therefore repelled by a magnetic repulsive force T. The exact mathematical expression of this repulsive force is given by $$T = \frac{\mu_o i_1 i_2 h}{\sqrt{h^2 + (R_1 + R_2)^2}} \left[ \frac{R_1^2 + R_2^2 + h^2}{(R_1 - R_2)^2 + h^2} E - F \right] \quad (2)$$

where F and E are the complete elliptic integrals of the first and second kinds, respectively given by $$F = \int_o^{\pi/2} \frac{dx}{\sqrt{1 - k^2 \sin^2 x}}$$

and $$E = \int_o^{\pi/2} \sqrt{1 - k^2 \sin^2 x}\, dx$$

where $$k^2 = \frac{4R_1R_2}{h^2 + (R_1 + R_2)^2}$$

If $R_1 >> R_2$ equation (2) can be expressed to a good approximation by the equation $$T = \frac{3\pi\mu_o R_1^2 R_2^2 i_1 i_2 h}{2(R_1^2 + h^2)^{2.5}} \quad (3)$$

where $\mu_o = 4\pi \times 10^{-7}$ henry/m (MKS units are used). See, *Introduction To Electromagnetic Fields And Waves*, Addison-Wesley Publishing Company, 1968, pp. 219–220, by E. V. Bohn. It is important to point out the fact that equation (3) demonstrates that the propulsive force T acting on the second coil 102 increases with the square of its radius $R_2$.

Suppose that the first coil 100 (field coil) is at rest on the earth's surface and the second coil 102 (propulsion coil) is being repelled above it by the magnetic repulsive force T. The downward force of gravity W acting on the second coil 102 is equal to $m_2 g$ where $m_2$ is equal to its mass and $g = 9.81$ m/sec$^2$ is equal to the average gravitational acceleration at the earth's surface. If the second coil 102 has a mass density $\rho$ and a current density J, the thrust to weight ratio T/W for the magnetically repelled coil 102 can be expressed as $$\frac{T}{W} = \frac{3\mu_o R_1^2 i_1 R_2 J h}{4g\rho(R_1^2 + h^2)^{2.5}} \quad (4)$$

It is apparent from this equation that the thrust to weight ratio of the magnetically repelled coil 102 can be increased by increasing its radius $R_2$ and its current density J. If the coils 100, 102 are superconducting, the values of $i_1$ and J can be made very large. Moreover, by utilizing superconducting coils, all internal electrical resistance vanishes, and the currents $i_1$ and $i_2$ do not have to be sustained by any external power source to make up for resistive losses.

There exists the practical problem of charging the second coil 102 with current $i_2$ without it being catapulted away from the first coil 100 (which is assumed to be fully charged with current $i_1$) before the second coil 102 can be fully charged. However, in view of equation (4), there is no upward thrust exerted on the second coil when h=o. In order for the coil 102 to be magnetically repelled away from the field coil 100, it must have some relatively small initial altitude $h_o$ where T/W=1. Thus, the second coil 102 can be charged with its current $i_2$ while resting on the earth's surface (at h=o) in the center of the larger field coil 100.

Let $B_1$ denote the magnetic field strength generated by the first coil 100 at its center. Hence $$B_1 = \frac{\mu_o i_1}{2R_1} \quad (5)$$

If $A_2$ denotes the area of the second coil 102, its magnetic dipole moment $M_2 = i_2 A_2$. Therefore, since $A_2 = \pi R_2^2$, the magnetic dipole moment $M_2$ of the second coil 102 can be expressed as $$M_2 = i_2 \pi R_2^2 \quad (6)$$

If the second coil 102 is charged with current $i_2$ when it is on the earth's surface in the center of the field coil 100, its magnetic potential energy $E_m$, which is equal to $B_1 M_2$, can be expressed as $$E_m = \frac{\mu_o \pi i_1 i_2 R_2^2}{2R_1} \quad (7)$$

This magnetic potential energy $E_m$ is converted into kinetic and potential energy by the second coil when it accelerates away from the first coil (which remains stationary) The mathematical expression of this energy represented by equation (7) clearly demonstrates that an enormous amount of magnetic potential energy $E_m$ can be fed into the second coil (by charging it with current $i_2$) if the coil is constructed with a very large radius $R_2$. The basic idea behind the invention essentially involves the recognition (through equations 3, 4 and 7) that enormous amounts of stored propulsive energy $E_m$ and propulsive thrust T can be achieved with the principle of magnetic repulsion by utilizing superconducting coils and scaling up their physical dimensions many orders of magnitude—far beyond anything previously contemplated. By constructing a superconducting field coil 100 with a radius of tens of kilometers and charging it with an enormous current $i_1$, it is possible to construct the superconducting propulsion coil 102 with a large radius and charge it with current $i_2$ to obtain an initial magnetic launch energy $E_m$ far greater than the initial chemical launch energy contained in the propellant of any prior art chemically propelled launch vehicle. In fact, equation (7) shows that, for all practical purposes, there is virtually no limit on the amount of launch energy $E_m$ that can be obtained for the magnetically propelled coil—and this launch energy $E_m$ will be converted into kinetic and potential energy with an efficiency of nearly 100% (compared to only about 2% for chemically propelled launch vehicles).

In order to better understand this propulsion concept, it may be helpful to consider a simple numerical example. Suppose the field coil 100 has a current $i_1 = 1.5 \times 10^9$ amp and a radius $R_1 = 10{,}000$ m. Suppose the current density of the second coil 102 is $J = 5 \times 10^8$ amp/m$^2$ and has a radius $R_2 = 1{,}000$ m with a mass density $\rho = 3{,}000$ kg/m. At an altitude h=10,000 m (32,800 ft) the thrust to weight ratio for the magnetically repelled coil 102 would be equal to 42.46. Thus, at this altitude, the coil 102 would be accelerating upward by the magnetic repulsive force with an acceleration of 41.46 g and would be moving with a velocity of 3.156 km/sec (7,059 MPH or Mach 10.2).

The corresponding velocity V at any altitude h can be calculated from the equation $$V = \{C[(R_1^2 + h_0^2)^{-1.5} - (R_1^2 + h^2)^{-1.5}] - 2G[(R_3 + h_0)^{-1} - (R_e + h)^{-1}]\}^{\frac{1}{2}} \quad (8)$$

where $$C = \frac{\mu_o R_1^2 i_1 R_2 J}{2\rho}$$

and $G = 3.981 \times 10^{14}$ m$^3$/sec$^2$ (earth's gravitational constant) $R_3 = 6371315$ m (earth's mean radius) and $h_o$ is equal to the launch altitude (which is equal to the initial height where T/W=1). For the above example $h_o = 41.16$ m and $C = 1.571 \times 10^{19}$ m$^5$/sec$^2$. The coil would be accelerated to a maximum altitude of 916 km. The altitude where the magnetic repulsive force is equal to the gravitational force (T/W=1) is 37.73 km (123,800 ft). This altitude could be sustained indefinitely by the propulsion coil without expending any energy.

This simple example demonstrates the very powerful propulsive forces that can be generated by magnetic repulsion when large superconducting coils are used. These propulsive forces are significantly greater than that which can be generated by conventional rocket engines. The most important fact however, that has profound importance in the field of space travel, is that these powerful propulsive forces are generated without using any propellant or any power generating system on the coil.

Before proceeding, it should be pointed out that although the construction of a 20 km diameter superconducting field coil would be expensive, it would cost significantly less than the $3 billion cost of the Superconducting Super Collider underground partical accelerator, with a diameter of 60 km that is being designed and constructed for high energy physics research. (See "The SSC: A Machine For The Nineties," *Physics Today,* March 1985, pp. 28–37, by S. Glashow and L. M. Lederman.) Using mass production techniques for manufacturing the superconducter, the cost of installing a 20 km diameter field coil could probably be kept to about $10 million per kilometer or $628 million. Thus, the concept of magnetic propulsion introduced herein is well within economic feasibility.

It follows from equation (4) that the thrust to weight ratio T/W of the Propulsion dipole 102 can be increased by maximizing the product $R_2J$. But the radius $R_2$ and current density J are not independent variables. They are related by the mechanical stress limitations generated by magnetic forces. Any current carrying conductor generates a magnetic field. This magnetic field generates $\vec{J}\times\vec{B}$ Lorentz forces on the conductor which, in turn, generates various mechanical stresses that must be contained by some supporting mass. In the case of superconducting propulsion coils described herein, the conductor itself is designed to contain these forces. Thus, in order to minimize the mass of a propulsion coil it will be designed to be a self supporting superconducting dipole. The stresses are contained by the superconducting cable used to construct the dipole.

The inductive energy E of a superconducting coil carrying a current i with self inductance L is given by the equation $$E=\tfrac{1}{2}L\, i_2 \tag{9}$$

Figure 9:
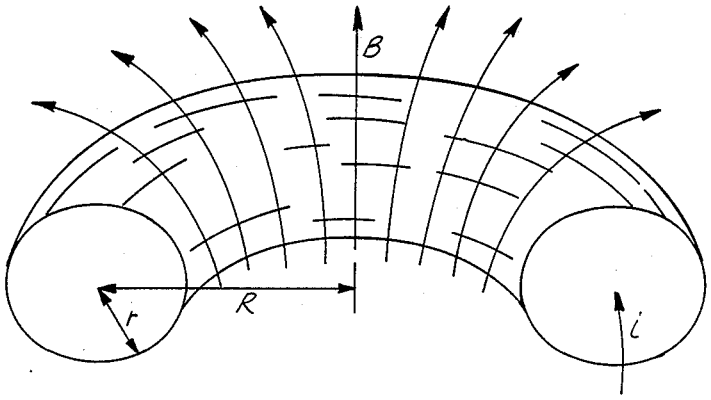
FIG. 9 is a perspective view of half of a dipole coil showing its relative geometrical relationships.

The self inductance of a dipole coil with major radius R and minor radius r (FIG. 9) is given by $$L=\mu_o R\,[\log(8R/r)-1.75] \tag{10}$$

Consequently, the total radial outward force F acting on the dipole is $$F=\frac{\partial E}{\partial R}=\tfrac{1}{2}i^2\frac{\partial L}{\partial R}=\tfrac{1}{2}i^2\mu_o[\log(8R/r)-.75]$$

where i denotes the total current flowing through the coil's total cross sectional area A . If $F_t$ denotes the total tension in the coil, its stress $\sigma=F_t/A_t=F_t/\pi r^2$. Consequently, since $F_t=F/2\pi$, it follows that $$F_t=\frac{F}{2\pi}=\frac{i^2}{4\pi}\mu_o[\log(8R/r)-.75]=\pi r^2\sigma \tag{11}$$

The magnetic field $B_o$ at the center of the dipole is given by $$B_o=\frac{\mu_o i}{2R} \tag{12}$$

and the maximum magnetic field $B_m$ which occurs on the surface of the dipole closest to the center, is given by $$B_m=\frac{\mu_o i}{2\pi r} \tag{13}$$

Consequently, since the aspect ratio $\gamma=R/r$, equation (11) can be expressed as $$B_0^2\gamma^2[\log(8\gamma)-0.75]=\sigma\pi^2\mu_o \tag{14}$$

Since the current i is related to the current density J by $i=JA_t=J\pi r^2$, it follows from equation (12) that $$JR=\frac{2B_o\gamma^2}{\pi\mu_o} \tag{15}$$

Hence, in view of equation (14) it follows that $$JR=2(\sigma/\mu_o)^{\frac{1}{2}}[\gamma/(\log(8\gamma)-0.75)^{\frac{1}{2}} \tag{16}$$

This equation is of fundamental importance because it relates the product JR to the tensile strength $\sigma$ of the superconducting cable and the aspect ratio $\gamma$ of the propulsion dipole.

Figure 10:
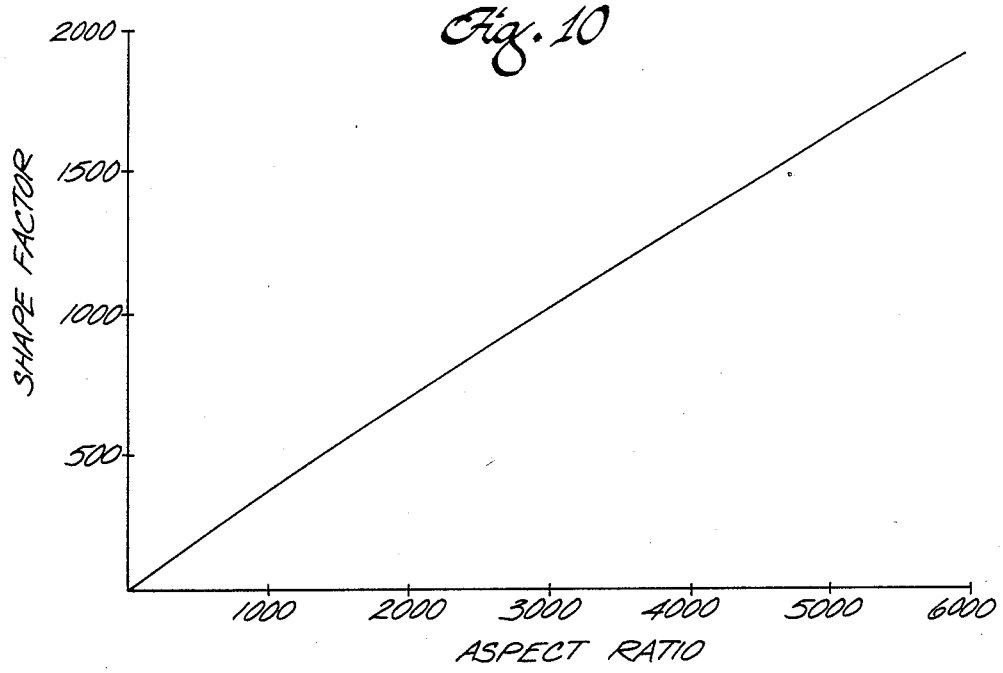
FIG. 10 is a graph of a propulsion coil's shape factor versus its aspect ratio.

The function F ($\gamma$) in the brackets of equation (16) defined by $$F(\gamma)=\gamma/[\log(8\gamma)-0.75]^{\frac{1}{2}} \tag{17}$$

is dependent only on $\gamma$ and hence the shape of the dipole (i.e., only on the relative thickness of its cross section). It will therefore be called the "shape factor". A graph of this function is shown in FIG. 10. It is very nearly equal to a straight line with a slope of 0.3. Hence, the product JR can be expressed to a good approximation by the equation $$JR=0.600\gamma\pi\sigma\sqrt{\mu_o} \tag{18}$$

This equation clearly demonstrates that the value of JR can be increased to arbitrarily large values by increasing $\gamma$. Consequently, in view of equation (4) the propulsive lifting and accelerating thrust that can be generated by this concept of magnetic propulsion has essentially no limits; (i.e., it is possible to construct an arbitrarily large self supporting superconducting propulsion coil, with an arbitrarily large superconducting field coil, and charge the propulsion coil with current to obtain arbitrarily high values for T/W without the propulsion coil bursting under self induced magnetic stress).

Although the magnetic propulsive thrust of a superconducting dipole coil having a given value of o can be increased to arbitrarily high values by designing the dipole with a sufficiently large aspect ratio $\gamma$, it is desirable to maximize the thrust for any given value of $\gamma$. In view of equations (4) and (18), this can be achieved by constructing the coil with tension bearing superconducting cable having high $\sigma/\rho$. The fabrication of such a cable is disclosed in my U.S. Pat. No. 4,078,747 filed June 2, 1975 entitled "Orbiting Solar Power Station." Basically this fabrication method involves reinforcing high strength, low density, superconducting cable previously fabricated by vapor depositing a thin layer of superconducting material onto high strength carbon fibers, with a tensile strength of $0.28\times10^{10}$N/m$^2$, with super high strength fused silica glass fibers, with a tensil strength of $1.4\times10^{10}$N/m$^2$. However, by using new high temperature ceramic superconducting material, the superconducting layer can be vapor deposited directly onto the fused silica glass fibers thereby eliminating the need for any carbon fibers. The technique of vapor depositing superconducting material onto high strength fibers is discussed in the article "Superconducting Properties of Thin Film Niobium Carbonitrides on Carbon Fibers," *IEEE Transactions On Magnetics,* Vol. Mag-11, No. 2, March 1975, pp. 185–188 by G. E. Pilce et al. Since experiments involving high temperature ceramic superconducting material indicate that such material is intrinsically stable, there is no need for any stabilizer material such as copper or aluminum. The resulting tension bearing superconducting cable fabricated by this technique will have a tensil strength $\sigma=1.4\times10^{10}$N/m$^2$, and a mass density $\rho=2160$/kg/m$^3$. This is the cable that will be used to construct the superconducting propulsion dipole.

In order to illustrate the above mathematical analysis, it may be helpful to consider another simple numerical example. Suppose a superconducting propulsion dipole is constructed with a major radius R equal to 100 m. In order to achieve a high thrust to weight ratio, the aspect ratio $\gamma$ (which is an independent design parameter of the dipole) should be very large. This parameter will be taken to be 2,000. Hence, the minor radius r of the dipole will be 100 m/2000=0.05 m. The quantity JR, which is calculated by equation (16) is $1.41\times10^{11}$ amp/m. Hence, the current density $J=(1.41\times10^{11}$ amp/m)/100 m$=1.41\times10^9$ amp/m$^2$. Assuming that the superconducting material is vapor deposited with a layer thickness of $0.2\times10^{-4}$ cm on a fiber with radius $3\times10^{-4}$ cm, the conductor to non-conductor cross sectional area ratio is 0.121. Hence, the actual current density $J_o$ of the current carrying superconducting material is $J0.121=1.164\times10^{10}$ amp/m$^2$. The total current flowing around the dipole is $i=JA_t=(1.41\times10^9$ amp/m$^2)$ $(7.85\times10^{-3}$m$^2)=1.11\times10^7$ amp. The maximum magnetic field strength $B_m$, which can be calculated from equation (13), is 44.4T. The values of these parameters (namely $J_o$ and $B_m$) are well within the range of observed values for high temperature ceramic superconducting material. See "High $T_c$May Not Need Phonons; Supercurrents Increase," *Physics Today,* July 1987, pp. 17–21, by A. Khurana; and "Superconductor Frenzy," *Popular Science,* July 1987, pp. 54–97, by A. Fisher. It should also be pointed out and emphasized that the superconducting propulsion dipole used in the present invention will be provided with a liquid hydrogen cryogenic environment at about 20° K. which is much colder than liquid nitrogen temperature which is 77° K. Therefore, the value of $J_o$ in a field $B_m$ would be well within operating limits.

The amount of inductive energy E of the dipole, which can be calculated from equations (9) and (10) is $6.14\times10$ Joules. The mass of the dipole $m=2\pi R\pi r^2\rho=10{,}659$ kg. Hence, $E/m=5.71\times10^6$ Joules/kg which is within the limit set by the Virial Theorem ($E/m<\sigma/\rho=6.48\times10^6$ Joules/kg).

Suppose this propulsion dipole is charged at the center of a field coil that has a radius $R_1=1{,}000$ m and a current $i_1=3\times10^9$ amp. In view of equation (7) the magnetic potential energy $E_m$ of the propulsion dipole would be $6.57\times10^{11}$ Joules. This is the energy that would be converted into kinetic and potential energy when the coil is launched. It is over ten times greater than the coil's total inductive energy which is $6.14\times10^{10}$ Joules. This illustrates he important fact that the propulsion dipole does not carry its propulsive energy with it as in the case of prior art launch vehicles. The propulsive energy $E_m$ is supplied primarily by the inductive energy of the field coil, which is many times greater than $E_m$. For example, if the field coil is constructed with a minor radius r of 6 m, its inductance L would be $6.84\times10^{-3}$ henrys (which can be calculated by equation (10). Hence, in view of equation (9), the initial inductive energy oi the field coil would be equal to $3.08\times10^{16}$ Joules, which represents an amount of stored energy that is 46,870 times greater than $E_m$. When the propulsion coil is accelerated away from the field coil, the inductive energy of the field coil is reduced by an amount approximately equal to $E_m$. But, since the initial inductive energy of the field coil is so great the decrease would only be about 1/46,870 or 0.002%.

The propulsive energy $E_m$ of a dipole can be arbitrarily increased to any desired value without increasing its size or current by simply increasing the current $i_1$ in the field coil and/or by simply increasing the number of field coils. Since the field coils remain stationary on earth, their mass is of no consequence. Moreover, they do not have to be self supporting as in the case of the propulsion dipole. Since they will be embedded in underground tunnels, the stresses could be supported by the surrounding earth itself. These beautiful operating characteristics of the system are extremely important as they enable it to easily outperform any prior art ground to orbit launching system, including all those involving beamed power transmission using laser or microwave beams.

In the preferred embodiment of the invention, there will be many (coaxial) field coils instead of only one. In view of the principle of field superposition, where the effective propulsive field is equal to the vector sum of the individual fields, the propulsive thrust and energy can be increased to achieve unlimited values by simply increasing the number of field coils—which can be easily accomplished since the field coils remain fixed in underground tunnels. In this case, the thrust to weight ratio given by equation (4) becomes $$\frac{T}{W}=\left(\frac{3\mu_o R_2 Jh}{4g\rho}\right)\sum_{j=1}^{n}\frac{i_{1j}R_{1j}^2}{(R_{1j}^2+h^2)^{2.5}} \tag{19}$$

where $R_{1j}$ is equal to the radius of the j'th field coil and there are n field coils altogether. The current in each field coil is equal to $i_{1j}$. The velocity V of the propulsion coil at any altitude h can be calculated by $$V=\left\{\left(\frac{\mu_o R_2 J}{2\rho}\right)\sum_{j=1}^{n} i_{1j}R_{1j}^2[(R_{1j}^2+h_o^2)^{-1.5}-(R_{1j}^2+h^2)^{-1.5}]-2G[(R_e-h_o)^{-1}-(R_e+h)^{-1}]\right\}^{\frac{1}{2}} \tag{20}$$

The total magnetic potential energy $E_m$ of the propulsion dipole is equal to $$M_2 \sum_{j=1}^{n} B_{ij}$$

where B is equal to the magnetic field strength at the center of the j'th coil generated by the j'th coil, and where $M_2$ is equal to the magnetic dipole moment propulsion coil. Hence, in view of equations (5) and (6) the total magnetic launch energy $E_m$ of the propulsion dipole can be expressed as $$E_m = \tfrac{1}{2}\,\mu_o \pi i_2 R_2^2 \sum_{j=1}^{n} i_{1j} R_{1j}^{-1} \tag{21}$$

Since the superconducting field coils are stationary and embedded in underground tunnels, the mechanical stress generated by their magnetic fields can be contained by the surrounding structure and supported by the earth itself. Thus, by eliminating the stress limitations on the field coils, the field coils can be designed to carry significantly more current than the propulsion coils (i.e., the current density J of the field coils can be designed to be much greater than that of the propulsion coils). Although the actual current densities $J_o$ of the current carrying superconductor will be about the same for propulsion coils and field coils, the conductor to non-conductor cross sectional area ratio of the field coils will be much greater than that of the propulsion coils.

Figure 11:
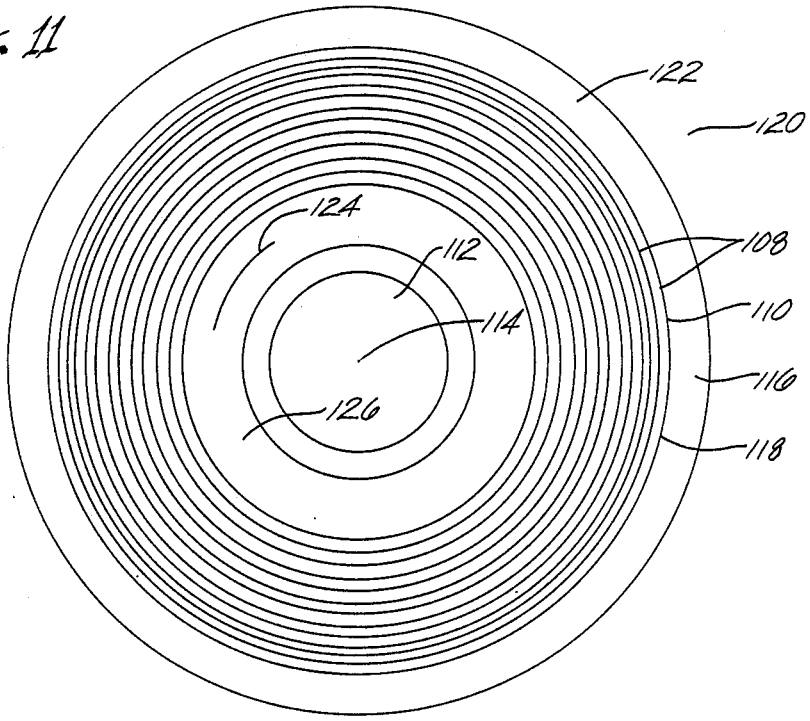
FIG. 11 is a schematic plan view illustrating the field coils in the referred embodiment and a plurality of annular arrays of photovoltaic solar cells for generating electrical energy.

In order to take advantage of the very favorable scaling laws that are inherent in the propulsion system disclosed herein, the preferred embodiment will be very large. There will be 14 superconducting field coils 108 (FIG. 11) mounted coaxially in underground tunnels 110 with increasing radii $R_{1j}$ ($j=1,2,3,\ldots 14$) equal to 60 km, 100 km, 105 km, 110 km, 115 km, 120 km 125 km, 130 km, 135 km, 140 km, 145 km, 150 km, 155 km, and 160 km. These coils will all be designed to carry a current $i_1$ of $1.5\times10^9$ amp. Since the system will cover a circular region 320 km (199 miles) in diameter, it will be constructed in some remote, and relatively flat area within the continental United States. Several such regions exist that would be suitable. The particular coil distribution selected, where most of the coils have a radius greater than 120 km, is designed to obtain a more uniform propulsive thrust over a greater arc of the ascent and descent trajectories so that the peak acceleration loads can be kept below 7 g. This will allow the system to be used for providing both passenger and cargo transportation to orbit. A relatively flat circular central region 112 is provided with a diameter of 50 km, that serves as the launching and landing region. It will be able to accommodate huge propulsion coils, 50 km in diameter. However, most of the propulsion coils will have much smaller diameters.

By employing large scale production facilities, the cost of manufacturing the field coils will be relatively low. For example, studies by John Gilman, at the Lawrence Berkeley Laboratory in Berkeley, Calif. have shown that new ceramic oxide high temperature superconducting material could be mass produced at a cost of only \$20/ton if the rate of production were 500,000 tons per year. This cost could be reduced to \$2/ton by producing 50,000,000 tons/year. See the article, "The Commercial Potential Of High-$T_c$ Superconductors," Physics Today, March 1988, by J. J. Gilman. The cost of producing fused silica glass (which would represent most of the mass of the propulsion coils) could be manufactured at a much lower cost. The underground installation cost could be reduced by installing the field coils in shallow trenches that can be dug very rapidly by automated trench digging machines. (Automated tunnel boring machines would be used under mountains and hills to maintain constant depth relative to the launch site.) Thus, in the preferred embodiment, a large number of field coils will be used extending out in nested, coaxial circles to a distance of 160 km (99 miles). This will multiply the magnetic propulsive thrust that can be generated by the system, especially at great distances from the launch point 114.

Since the local magnetic field on the earth's surface in an annular region 116 surrounding the outer field coil 118 will be many times greater than the earth's natural magnetic field, it will be kept isolated from the more distant surrounding region 120 where the field is not as great. In order to make good use of this isolated region 116, it will be used for generating electrical energy via photovoltaic solar arrays. The presence of a magnetic field does not affect the operation of photovoltaic solar cells. Thus, in the preferred embodiment of the invention, a huge annular array 122 of solar cells, 18 km wide with an inner radius of 162 km, and an outer radius of 180 km, is constructed around the outer field coil 118 for generating bulk electric power. This array 122 will cover a total land area of about 19,300 km$^2$.

The solar array 122 can be constructed from long continuous sheets of thin film amorphous silicon cells and mounted in rigid, 10 m long by 3 m wide modules produced in huge automated factories to reduce unit cost. The raw materials needed for the production, namely silicon, is the second-most abundant element on earth. Hence, by increasing the scale of the production facilities, it should be possible to construct the array with a unit cost of about \$20/m$_2$. (See "Photovoltaic Power," *Scientific American* April 1987, pp. 87–92, by Y. Hamakawa.) Thus, the total cost of the array will be about \$390 billion with an average operating efficiency of 15% the total amount of electric power that could be generated by the system is 2,900 GW. Since the solar array can only generate electric power during the daylight hours, the average daily power output of the system will be about 600 GW. However, this is still significantly more electric power than the total generating capacity of the United States. Thus, the complete ground to orbit transportation system envisioned herein also represents a giant electric power generating plant. Since this electric generating system does not burn any combustible or nuclear fuel, and has no moving parts, it would require very little maintenance and it could remain operating indefinitely. The operating cost would be nearly zero. A large portion of the excess power could be fed into the existing U.S. electric power intertie grid for distribution throughout the United States and Canada. Large portions could also be fed into Mexico and other countries via superconducting power transmission lines. Large portions could be transmitted to Europe and Japan via microwave power transmitting and receiving stations using passive orbiting reflector satellites. This electric power generating capability of the system would therefore enable many (if not all) thermal electric power plants to be dismantled thereby eliminating all atmospheric and thermal pollution caused by these plants. It would also have a substantial beneficial effect on the total U.S. economy since it would not only reduce the national balance of payments, but reverse it on a colossal scale.

The initial construction cost of $390 billion for the array could be recovered by the commercial sale of the electric power generated therefrom. For example, if the average output of the array is 500 GW per year, and if the average commercial sale of the electrical energy is 10¢/KW-hr, the amount of income revenue that could be generated by the array over a one year time period would be $440 billion. This amount is significantly more than the array's construction cost.

Since the solar array can only generate electric power during the daylight hours, a large underground superconducting inductive energy storage system 124 is provided for accumulating part of the electrical energy generated during the daylight hours so that it can be released into the power distribution system during the non-daylight hours. Thus, the storage system serves as a giant load leveling system that allows electric power to be fed into the distribution system at a nearly uniform rate, 24 hours per day. The design of this inductive energy storage system is basically a scaled up version of that proposed by R. W. Boom in his paper, "Superconductive Energy Storage For Diurnal Use By Electric Utilities," *IEEE Transactions On Magnetics* Vol. MAG-17, No. 1, Jan. 1981, pp. 340–343. By constructing this system with huge dimensions, it is possible to again take advantage of favorable scaling laws (of inductive energy storage systems) to obtain a system capable of storing an enormous amount of energy with relatively low construction cost. However, it should be noted that a separate inductive energy storage system may be unnecessary. The field coils themselves could also be used as a giant superconducting inductive energy storage system. Since the total amount of inductive energy stored in the coils is so great, the amount of additional energy put into the system (or withdrawn from the system) represented by the output of the array over one or two days operation is relatively small and will not cause any significant change in the magnetic field. The cost of the entire system could be substantially reduced by utilizing the field coils as the inductive energy storage system.

In order to get maximum use of the large land area immersed in the magnetic field, additional solar arrays 126 are mounted between the field coils 108 for increasing the electric power generating capacity of the system. For example, if 50% of the area inside the outer field coil 118 is covered with solar arrays, an additional 6,000 GW of electric power could be generated. A substantial portion of this power could be held in reserve for use in national defense. In particular, it could be used for instantly energizing various directed energy weapon systems in a national emergency. This capability would be extremely valuable to our country's critically important SDI program since the engineering feasibility of such beam weapon systems depends largely upon the availability of a sufficiently large power source.

Figure 12:
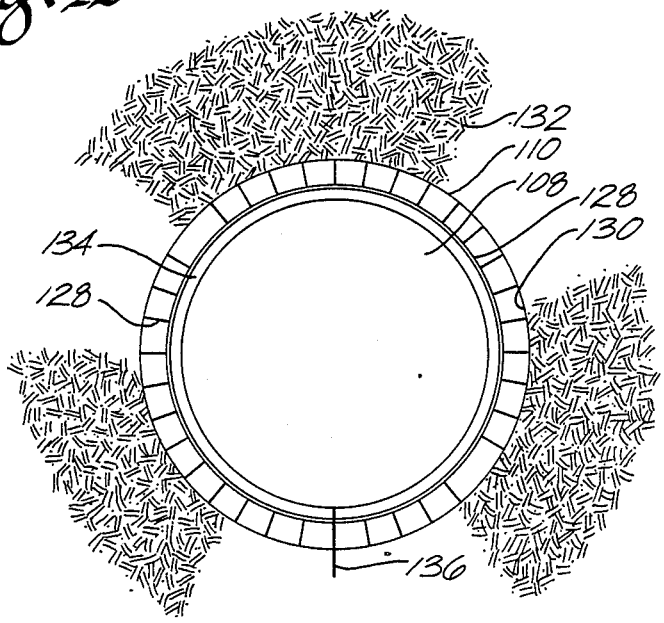
FIG. 12 is a schematic transverse cross section illustrating a superconducting field coil mounted inside an underground tunnel.

FIG. 12 is a schematic transverse cross section of a superconducting field coil 108 mounted inside an undergound tunnel 110 and supported by a surrounding structure 128. This structure 128 is itself supported by the tunnel walls 130 and the surrounding earth 132. A liquefied nitrogen cryogenic Dewar system 134 is provided for maintaining the coil 108 at liquefied nitrogen temperatures. This enables the maximum magnetic field $B_m$ of the coil to exceed 100 T. In the preferred embodiment, $B_m=75$ T. The coil's minor radius r is designed to be 4.0 m. Hence, it follows from equation (13) that the current $i_1$ of each field coil 108 will be $1.5\times10^9$ amp and the current density will be $2.98\times10^7$ amp/m$^2$. (Since the actual current carrying superconducting material will represent about 25% of the total cross sectional area of the coil 108, the actual current density $J_o$ of the superconductor will be about $1.2\times10^8$ amp/m$^2$). Current is fed into and withdrawn from the field coils 108 by a plurality of superconducting power transmission lines 136 that are connected to the superconducting magnetic energy storage system 124 and to the solar arrays 122,126.

Since the ground to orbit propulsion concept disclosed herein is fundamentally different from any prior art system, it has unique and radically different operating characteristics. One important difference concerns the injection orbit. The payload capability of any propulsion coil depends upon the altitude of the injection orbit. As is the case for all launch vehicles, the higher the altitude the lower the payload. However, unlike prior art launch vehicles, the altitude of the coil's injection orbit is not a variable that can be arbitrarily selected. In order to enable the Propulsion coil to return to the launch site by regenerative magnetic deceleration forces generated by the field coils, the injection orbit must be such that it will carry the coil back over the launch site at some future time. However, since the earth moves the launch site by virtue of its rotation, the launch site will not be under the coil after the coil makes one complete revolution in its orbit. The orbital mechanics of the situation are such that in order for the coil to pass over the launch site at some future time, it must have an orbital period that is a rational fraction of one sidereal day (i.e., its orbital period $P_c$ must be expressible as $(n_1/n_2)\,P_s$ where $P_s$ is one sidereal day and $n_1$ and $n_2$ are integers). These orbits are called "resonant orbits". If $n_1=1$, the coil will pass over the launch site exactly one sidereal day after it is launched after making $n_2$ complete orbit revolutions. This is the shortest possible time interval between successive pass covers. Thus, the injection orbit for the payload will be designed such that its orbital period $P_c=P_s/n_2$ where $P_s=86164.099$ seconds and $n_2$ will be some integer$\leqq16$. Each integer $n_2$ corresponds to a unique orbital altitude that can be determined from the equation $P_c=2\pi\sqrt{a^3/G}$ where a denotes the radius of the orbit and $G=398600.7$ km$^3$/sec$^2$. The orbital altitude $h=a-R_e$ where $R_e$ is equal to the earth's mean radiums 6371.3 km. If $n_2=16$, h=269.1 km. If $n_2=15$, h=561.1 km. (If $n_2=17$, h=3.3 km which is too low.) Consequently, in order to enable the coil to inject a maximum payload into orbit, the resonant orbit with $n_2=16$ having an altitude of 269.1 km will always be selected for the injection orbit. The launch azimuth can be any angle, but the injection orbit will always have an altitude of 269.1 km. The corresponding orbital velocity at this altitude is $V_o=\sqrt{G/a}=7.748$ km/sec. Assuming that the launch site has a latitude of 34° N and the coil is launched due east, the earth's rotation will give the coil an additional velocity of 0.370 km/sec. Hence, the required injection velocity $V_i=V_o-0.390$ km/sec$=7.358$ km/sec. Since the propulsion coil is not equipped with any separate propulsion system (except for its relatively small retro rocket and maneuvering thrusters) the system is designed to accelerate the coil and its payload directly into the circular parking orbit with an altitude of 269.1 km.

The total specific energy $\hat{E}_o$ of the coil at the injection point is equal to the sum of its kinetic and gravitational potential energy which is given by $$E_o = \tfrac{1}{2} V_i^2 + G\left[\frac{1}{R_e} - \frac{1}{R_e + h}\right] \tag{22}$$

Since $V_i = 7358$ m/sec and $h = 269100$ m, the total specific energy $\hat{E}_0 = 2.9602 \times 10^7$ Joules/kg. Therefore, the total initial specific magnetic launch energy $\hat{E}_m$ that the propulsion coil must have in order to propel itself and the payload into the required parking orbit is $$\hat{E}_m = \hat{E}_o + \hat{\Delta}_m \tag{23}$$

where $\hat{\Delta}_m$ is equal to the specific magnetic potential energy at the parking orbit altitude. If the parking orbit altitude is significantly greater than the diameter of the outer field coil, then $\hat{\Delta}_m \approx 0$. However, since this is not the case for the preferred embodiment, $\hat{\Delta}_m$ cannot be ignored. If the total launch mass is $m_t$ and the coil mass is $m_c$, then $\hat{\Delta}_m$ can be expressed as $$\hat{\Delta}_m = \frac{\mu_o i_1 S_2 R_2 J}{4\rho(m_t/m_c)} \tag{24}$$

where $$S_2 = \sum_{j=1}^{n} R_{1j}^2 (R_{1j}^2 + h^2)^{-1.5} \tag{25}$$

The required magnetic launch energy $E_m = m_t \hat{E}_m$.

If the minor radius of the propulsion coil is denoted by $r_2$, the coil's current $i_2 = J\pi r_2^2$ and its mass $m_c = 2\pi R_2 \pi r_2^2 \rho$. Therefore, if $$S_1 = \sum_{j=1}^{n} R_{1j}^{-1} \tag{26}$$

it follows from equation (21) that $$\frac{E_m}{m_c} = \frac{\mu_o i_1 S_2 R_2 J}{4\rho} \tag{27}$$

When this equation is combined with equations (23), (24) and (16), the "mass ratio" $m_t/m_c$ of the magnetic propulsion system can be expressed as $$\frac{m_t}{m_c} = \frac{(S_1 - S_2) i_1 (\mu_o \sigma)^{\frac{1}{2}}}{2\rho E_o}\left[\frac{\gamma}{[\log(8\gamma) - .75]^{\frac{1}{2}}}\right] \tag{28}$$

which, in view (18) can be expressed to a good approximation by $$\frac{m_t}{m_o} = \frac{.150(S_1 - S_2)\, i_1 (\mu_o \sigma)^{\frac{1}{2}}\, \gamma}{\rho E_o} \tag{29}$$

Since the parameters $\sigma$, $\rho$, and $\hat{E}_o$ are fixed constants, the mass ratio of the propulsion coil depends only upon the coil's aspect ratio $\gamma$. Thus, the mass ratio can be arbitrarily increased to any desired value by increasing the aspect ratio. (For the magnetic propulsion concept introduced herein, the efficiency of the propulsion system increases with increasing mass ratio instead of decreasing with mass ratio as in prior art rocket propulsion systems.)

Figure 13:
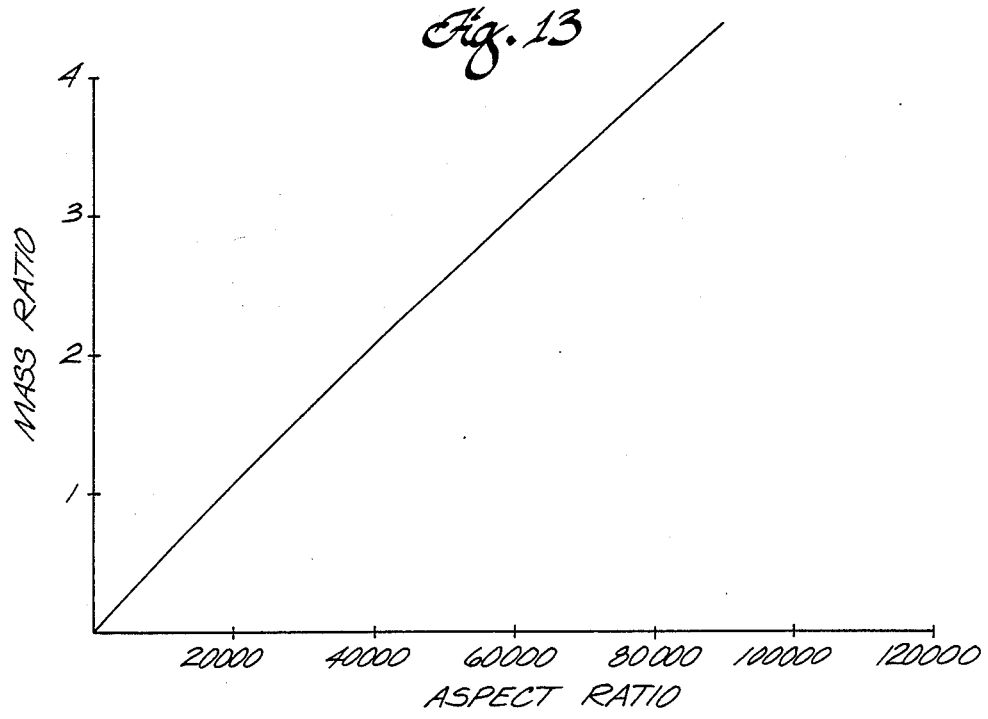
FIG. 13 is a graph of the mass ratio versus aspect ratio of a magnetic propulsion dipole designed to accelerate payloads directly into a 269.1 km high circular resonant injection orbit corresponding to the field coil distribution of the preferred embodiment.

Since the propulsion coil must be able to propel its own mass to orbit, the minimum mass ratio for the propulsion coil must be equal to 1.0. The values of $S_1$ and $S_2$ corresponding to the field coil distribution in the preferred embodiment are $S_1 = 1.1881777 \times 10^{-4} m^{-1}$ and $S_2(h = 269100) = 8.37886 \times 10^{-6} m^{-1}$. Thus, the minimum aspect ratio $\gamma_m$ in the preferred embodiment is 19,483. This can be achieved by constructing the major radius $R_2$ of the propulsion coil very large (several kilometers) with a very small minor radius $r_2$ (a few centimeters). Although such a huge coil represents an extremely unusual launch vehicle, it will be able to generate propulsive forces to accelerate extremely high mass payloads to orbit way beyond anything previously imagined. Moreover, the fact that the propulsion coil will have such a large diameter, enables the payload to have, for all practical purposes, unlimited physical dimensions (which is impossible in the prior art). A graph of the coil's mass ratio $m_t/m_c$ versus $\gamma$ given by equation (28) for the preferred embodiment is illustrated in FIG. 13.

Figure 14:
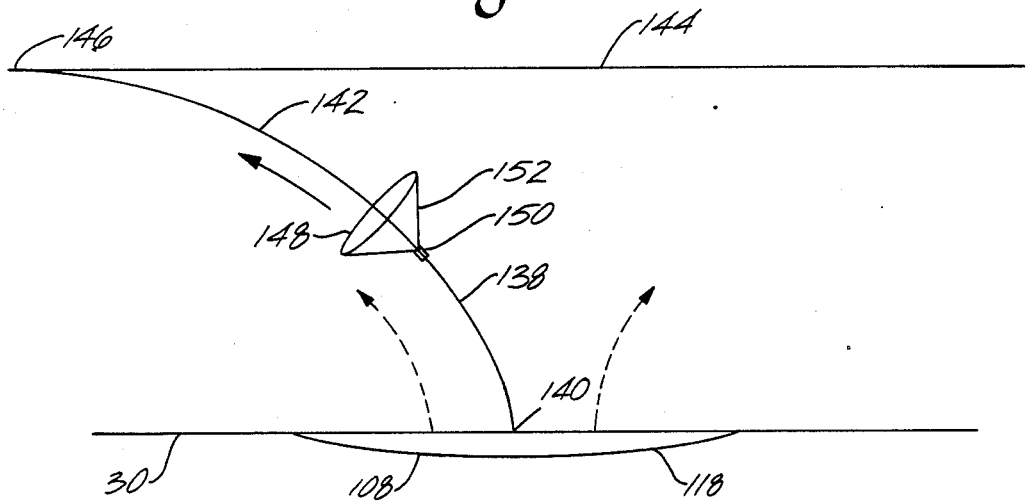
FIG. 14 shows the ascent trajectory of a magnetic propulsion system accelerating a payload by magnetic repulsive forces from the launch point on the earth's surface, to the 269.1 km high resonant injection orbit by converting electrical energy into orbital energy via an inductive coupling with the field coils.

The ascent trajectory will be along a curve of magnetic induction generated by the field coils that is vertical at the launch point and tangent to the injection orbit at orbital altitude Omitting the mathematical details it can be shown that this curve can be represented in polar coordinates by the equation $r = K \sin^2\theta$ where K is a constant equal to 699.142 km. At the launch point, $\theta = 0$ and $r = 0$. At the point where it intersects the injection orbit, $\theta = 54.736°$ and $r = 466.095$ km. The arc length s of this ascent trajectory is 501.630 km. If the acceleration $a_c$ remains approximately constant along a major portion of the curve, the acceleration $a_c \approx V_i^2/(2s) \approx 6g$. This is about equal to that of the U.S. Space Shuttle. FIG. 14 shows this ascent trajectory 138, that begins vertically from the center 140 of the field coils 108 (where $\theta = 0$, $r = 0$) and follows along a line of magnetic induction 142 which intercepts the resonant injection orbit 144 at a tangent point 146. At this point 146 the propulsion coil 148 is moving at a velocity $V_o = 7.748$ km/sec (with respect to an earth centered inertial frame) and the magnetic accelerating thrust is terminated by the coil's guidance system.

After the coil 148 is injected into the resonant parking orbit 144, the payload 150 is detached from the coil 148. The coil's inductive energy while in orbit will be significantly less than its initial inductive energy because the magnetic flux through the coil generated by the field coils during the acceleration vanishes. The coil's current while in orbit will be significantly less than its launch current $i_2$. The coil will therefore generate a relatively weak magnetic field in orbit. The magnetic field of the coil can be further reduced by programming the switching circuits to reverse the flow of some portion of the current. However, some magnetic field will be maintained in order to keep the connecting cables 152 under tension, and to maintain some hoop stress in the coil so as to maintain its circular shape.

The orbiting coil never passes over, or approaches the field coils during the first 14 orbit revolutions. Thus, the only magnetic field sensed by the coil in the parking orbit is the natural magnetic field of the earth. This field will exert a magnetic torque on the coil which keeps the plane of the coil perpendicular to the earth's natural magnetic flux. The coil's orbital path will take it directly over the launch site and field coils at the beginning of the 16th orbit.

Figure 15:
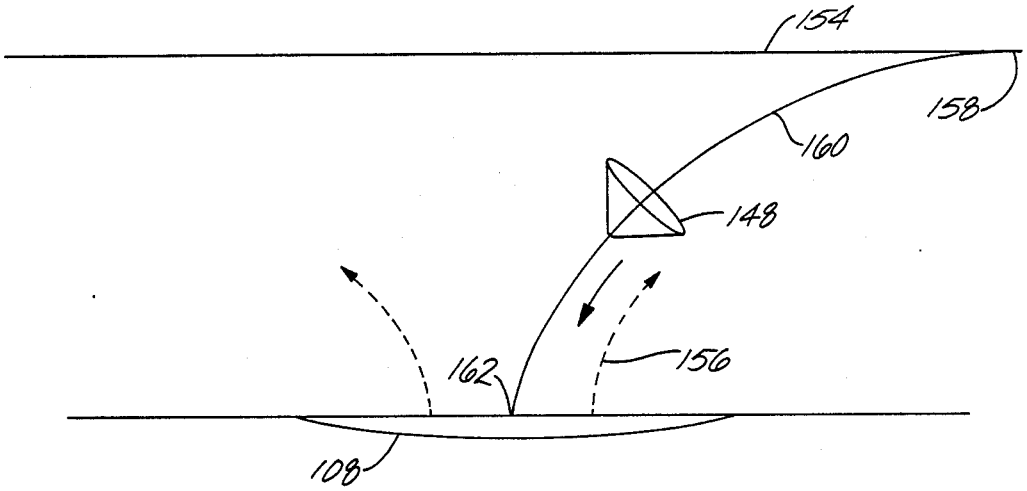
FIG. 15 shows the descent trajectory of a magnetic propulsion system decelerating from orbit back to the launch point by regenerative magnetic repulsive forces by converting its orbital energy back into electrical energy via an inductive coupling with the field coils.

After the coil 148 makes 15½ orbit revolutions, the retro rocket is fired which decreases the coil's velocity by a small amount ($\Delta V = 35$ m/sec). The new (post retro) orbit 154 will bring the coil 148 back over the field coils 108 at an altitude of 150 km (FIG. 15). When the coil 148 begins to approach the field coils 108 near the end of the 15th orbit, the magnetic field 156 generated by the field coils 108 becomes stronger than the earth's natural magnetic field. The plane of the coil therefore shifts a few degrees and automatically assumes an attitude perpendicular to the magnetic flux lines 156 generated by the field coils 108. Since this field 156 is about 500 times stronger than the earth's natural magnetic field at this point 158 and has a much greater field gradient, the coil 148 automatically begins to decelerate via magnetic repulsive forces. Since the mass of the coil 148 is relatively low without the payload, this deceleration is fairly high. The magnetic flux build up through the coil 148 increases, thereby automatically increasing its magnetic dipole moment, which automatically increases the deceleration. The magnetic repulsive forces rapidly increase above the gravitational force, and the coil 148 begins to lose altitude. The coil's internal guidance system automatically guides it through the upper atmosphere along a predetermined path 160 which defines its descent trajectory 160 back to the launch site 162. The coil 148 is decelerated along a line of induction such that it comes to rest exactly where it departed, one sidereal day after it was launched.

Figure 16:
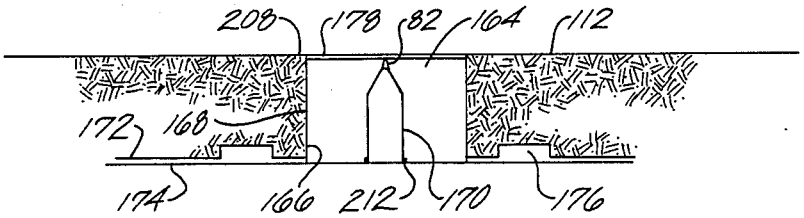
FIG. 16 is a schematic vertical cross section through the center of the field coils illustrating a large underground payload assembly room where the payloads are launched.

The local magnetic field at the center 114 of the launch site (FIG. 11) will be 1,120 Gauss. However, since the gradient of this field is essentially zero throughout the entire launch region 112, it will not exert any significant forces on paramagnetic or ferromagnetic objects. Payloads that are to be launched by the propulsion system are assembled inside a huge circular underground assembly hangar 164 with a diameter of 300 m and a height of 200 m (FIG. 16). This hangar is similar to a giant indoor football stadium with vertical walls. The external walls 166 of this hangar 164 are fitted with superconducting shielding coils 168 which prevent the magnetic field from entering the assembly hangar 164 while a payload 170 is being assembled. Likewise, the external walls 172 of all access tunnels 174 and all underground support rooms 176 are also fitted with superconducting shielding coils to provide a field free environment. When a payload 170 is ready for launching, giant doors 178 above the hangar 164 are opened. All personnel needed to prepare the payload for launching when the doors 178 are opened are provided with flexible suits lined with fabric woven with superconducting filaments. Thus the personnel are able to work in the field without actually being exposed to it. However, it should be noted that since there is no medical evidence indicating that exposure to 1 KG magnetic fields is biologically harmful, such exposure is not considered to be a critical health problem as is the case for radiation exposure.

Figure 17:
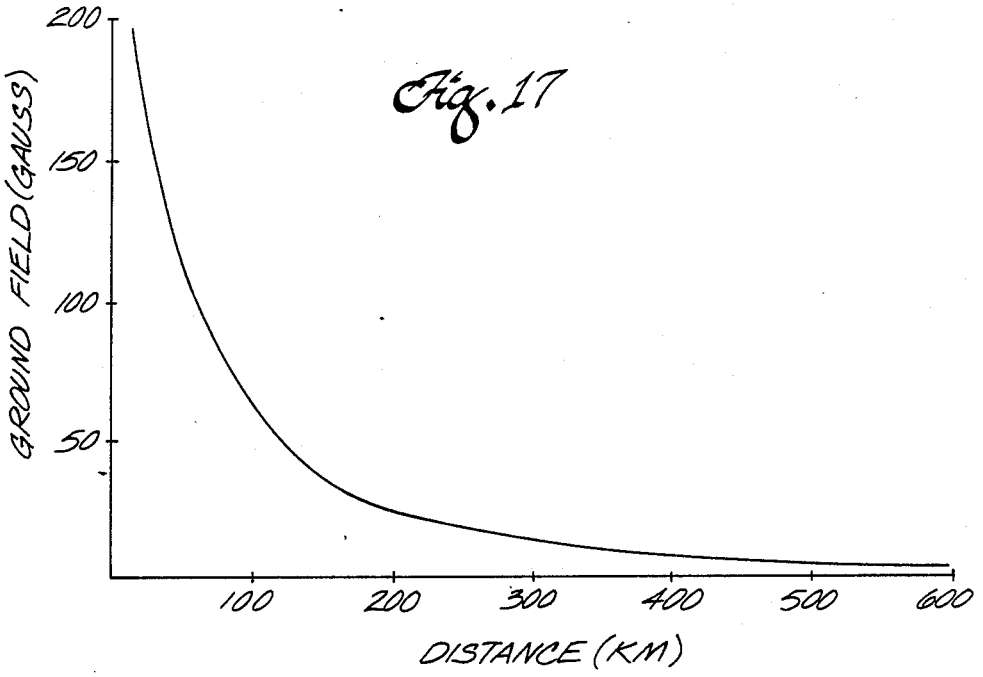
FIG. 17 is a graph showing the magnetic field strength on the earth's surface generated by the field coils at various distances from the outer field coil.

Although the local magnetic field on the earth's surface inside the central region 112 is very large, it is relatively low outside the outer field coil 118. For example, at a distance of 40 km from the outer field coil 118 (200 km from the center) the ground field is 134 Gauss, which (because of the small gradient) is imperceptible. At a distance of 100 km from the outer field coil 118 (260 km from the center 114) the ground field would be only about 60 Gauss and it would decrease very rapidly beyond this point, essentially inversely with the cube of the distance from the center 114. In order to make good use of the land area in, and close to the coil field, where the magnetic field strength is too high for commercial utilization (such as for agriculture) it is utilized to generate tremendous amounts of electrical energy via vast arrays of photovoltaic solar cells (which are not affected by the magnetic field). FIG. 17 is a graph of the magnetic field strength (Gauss) on the earth's surface versus distance d (km) from the outer field coil 118.

Figure 18:
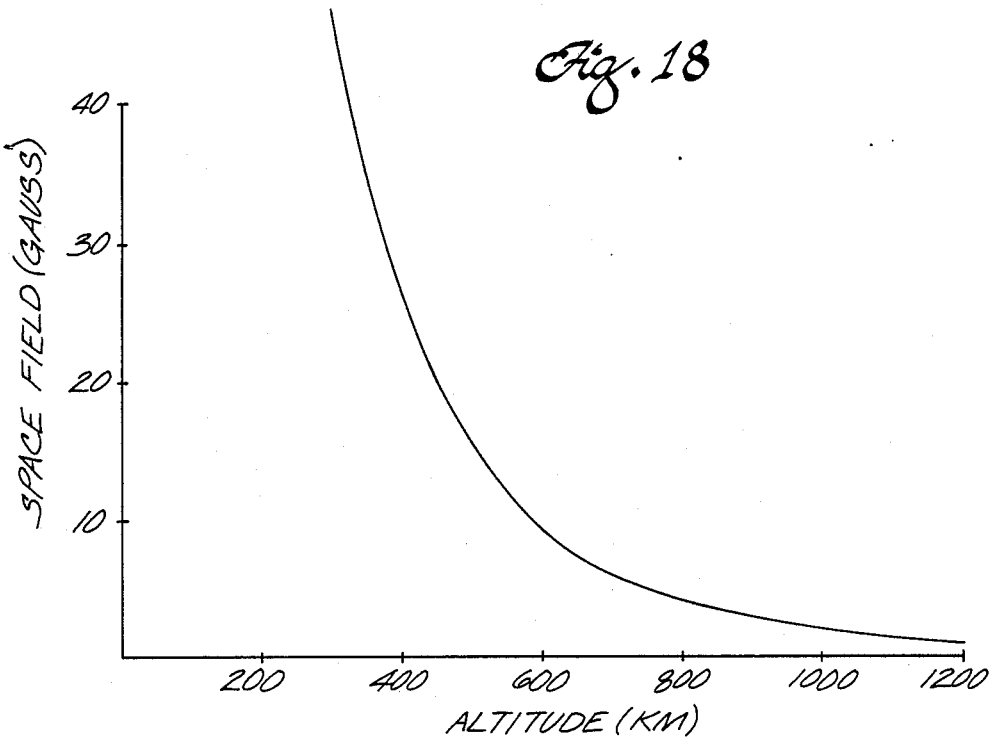
FIG. 18 is a graph showing the magnetic field strength in space directly above the center of the field coils at various altitudes.

The region in space directly above the field coils 108 would also be relatively weak at orbital altitudes. Thus, the system will not affect any artificial satellites moving in orbit passing above the field coils. FIG. 18 is a graph of the magnetic field strength in space directly above the center of the field coils versus altitude. At an altitude of 500 km, the field strength is only 15 Gauss, and at 1,000 km the field strength is 2 Gauss. At altitudes above 300 km, the field strength decreases very rapidly, inversely with the cube of the altitude. At an altitude of 2,000 km, the field is only 0.3 Gauss which is approximately equal to the earth's natural magnetic field at this altitude. Thus, the magnetic field strength generated by the field coils is such that it decreases very rapidly beyond the altitude of the injection orbit. This is a beautiful situation as it allows the field to be relatively high in a region where it is used to propel the propulsion coil, but it decreases very rapidly beyond the point where the coil is injected into orbit and the propulsion is terminated.

Figure 19:
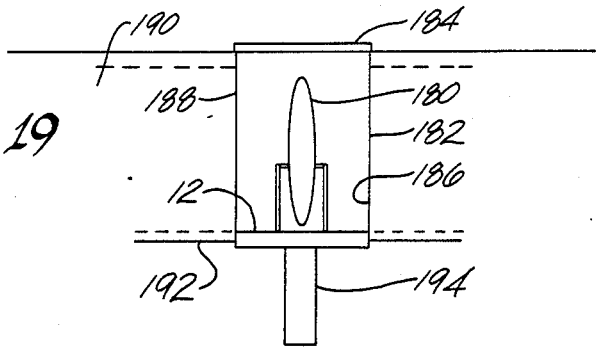
FIG. 19 is a schematic vertical cross section through a propulsion dipole illustrating a circular underground storage hanger and its retractable launching and landing platform.

As described above, there are many different propulsion coils 180 with various diameters that can be used in the system (i.e., that can be propelled by the field coils). These coils are stored in circular coaxial underground trenches 182 (FIG. 19) that are only a few meters wide and a few meters deep. These trenches represent the hangars for the propulsion coils 180. They are covered by a plurality of sliding doors 184 mounted above the storage hangars 182. The walls 186 of the hangars 182 are also filled with superconducting shielding coils 188 in order to provide a field free storage environment. Access tunnels 190 connecting each coil hangar 182 allow technicians to service the propulsion coils 180. Superconducting power transmission lines 192 are provided for charging a coil before launch, and for discharging it into the energy storage systems after the coil returns from orbit (by regenerative decelerating magnetic propulsion).

Figure 20:
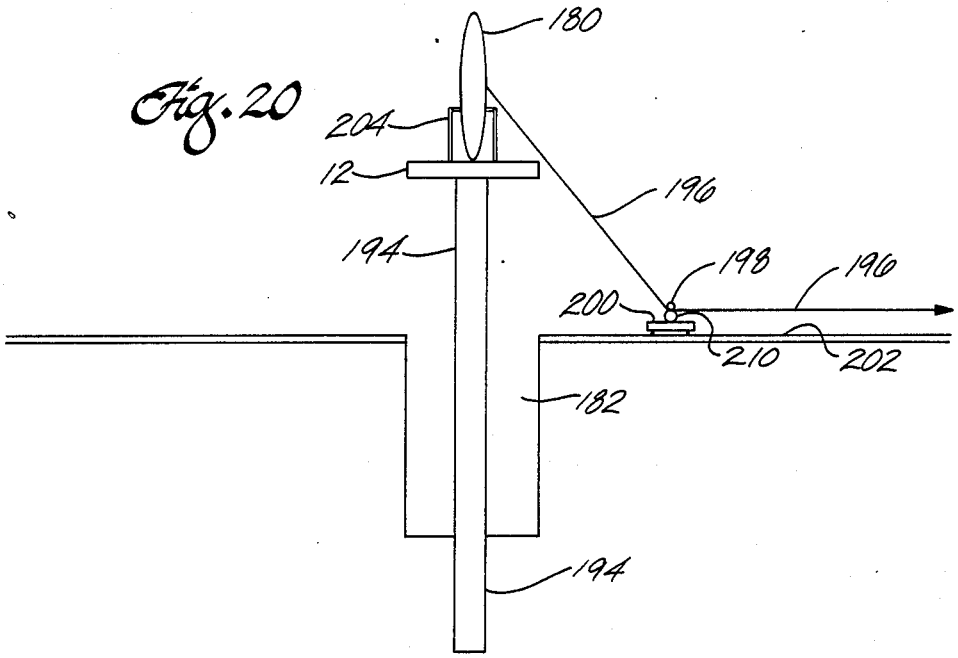
FIG. 20 is a schematic vertical cross section illustrating a propulsion dipole resting on its extended platform above ground level prior to launch.
Figure 21:
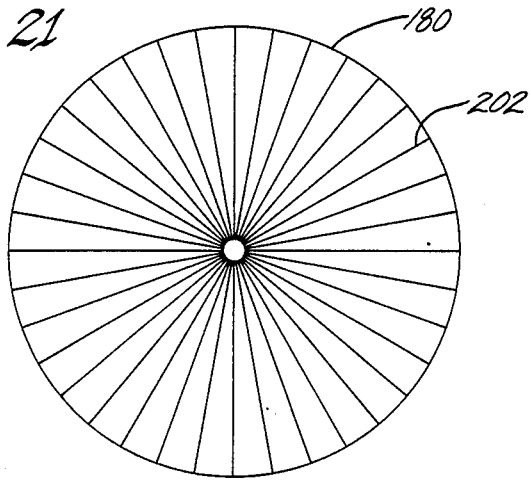
FIG. 21 is a schematic plan view illustrating a plurality of radial guide tracks used for holding down the connecting cables of a propulsion dipole while it is levitated off the ground by magnetic repulsive forces prior to launch.

The annular floor 12 (i.e., platform) of the propulsion coil 180 can be raised and lowered by a telescoping, electrically driven elevator system 194. This system 194 can raise the coil 180 out of its underground storage hangar and up to a height of several meters above ground level. The actual launching process takes place by a sequences of steps. The elevator 194 first lifts the coil 180 out of its annular underground hangar 182. The connecting cables 196 are attached to a plurality of pulleys 198 (FIG. 20) that are mounted on rollers 200 that move on a network of radial guide tracks 202 (FIG. 21) that converge to the center of the complex. The end of the cables 196 are connected to the aeroshell 82, which is itself connected to the payload 170. The propulsion coil 180 is charged with current via the superconducting power transmission lines 192 before it leaves its hangar 182. A plurality of hold-down launching clamps 204 prevent the coil from lifting off its launching platform 12 while it is raising the coil 180 out of the underground storage hangar 182. After the platform 12 is fully extended, the clamps 204 are released and the coil begins to slowly lift off the platform levitated by magnetic repulsive forces generated by the field coils 108. When the propulsion coil 180 begins to ascend, the connecting cables 196 come under tension and provide a strong downward force that prevents the coil from rising too rapidly. The pulleys 198, mounted on their electrically driven rollers 200, begin moving simultaneously along the guide tracks 202 in a converging direction toward the assembly hangar 164 as shown in FIG. 21. The guide tracks 202 end at the outer perimeter 208 of the underground assembly hangar 164. When the rollers 200 reach the point, the pulleys 198 are released from their rollers by a secondary cable system 210 attached to the pulleys that unwind and allow the connecting cables 196 to assume straight lines from the propulsion coil 180 to the aeroshell 82. After this step is accomplished, the pulleys 198 are released from the connecting cables 196 by an electromagnetic releasing mechanism. A plurality of hold down clamps 212, connected to the poyood 170, prevent the propulsion coil 180 from launching the payload 170 until the proper launch time arrives. At this moment, the clamps 212 release the poyood 170 and it, along with the aeroshell 82, begins to accelerate upward along a nearly vertical ascent trajectory.

The following numerical example is given to illustrate, quantitatively, the preferred embodiment of the invention. This particular example is designed to demonstrate the tremendous payload capability of the magnetic propulsion system. As explained above, since the parameters $\rho$ and $\sigma$ are already determined and remain constant for all propulsion coils ($\rho=2160$ kg/m$^3$, $\sigma=1.4\times10^{10}$N/m$^2$) it follows from equations (16) and (19) that the thrust to weight ratio T/W of a propulsion coil is determined only by the aspect ratio $\gamma$. The aspect ratio can be made arbitrarily large and does not depend upon any other parameter (but it must be greater than $\gamma_m=19{,}483$). Therefore, in view of equation (18) the coil's thrust to weight ratio can be made arbitrarily large. In the present example, the aspect ratio $\gamma$ will be chosen to be 100,000. The radius of the propulsion coil $R_2$ (which is also an independent design parameter) will be chosen to be 10,000 m. These values determine the coil's radius $r_2=R_2/\gamma=0.10$ m. Thus, the propulsion coil will have a diameter of 20 km (12 miles) but a cross sectional diameter of only 20 cm (7.87 in). Its total mass $m_c=4{,}264{,}000$ kg. In view of equation (16), the product $JR=5.891\times10^{12}$ amp/m. Hence, the current density $J=5.89\times10^8$ amp/m$^2$ nd $i_2=1.85\times10^7$ amp.

The magnetic launch energy $E_m$ can be calculated from equation (27) and is $6.5106\times10^{14}$ Joules. In view of equation (28) the mass ratio $m_t/m_c=4.795$. Hence, the total launch mass $m_t=20{,}443{,}000$ kg (45,069,000 lbs or 22,530 tons). This launch mass (which exceeds that of the giant British passenger liner Titanic) is many times greater than the largest mass ever orbited—and it is achieved by converting electrical energy into orbital energy with an efficiency of nearly 100%. (Most of the accelerating propulsion takes place outside of the earth's sensible atmosphere where drag forces are essentially zero.)

In order to calculate the actual payload mass, the total mass of the propulsion system and connecting cables must be determined. Since the structural mass of the airfoil surrounding the propulsion coil, including all internal components except the coil itself, will have a mass equal to about 25% of the total coil mass, this mass will be about 1,000,000 kg, The airfoil will have a chord of about 2.5 m and a thickness of about 30 cm (12 in). Therefore, the total mass that will be accelerated by the cables will be 15,179,000 kg. This particular payload is assumed to be unmanned so that the propulsion coil will be operated with maximum dipole moment (i.e., without any current reversals to decrease propulsive thrust). Thus, the ascent trajectory will generate a maximum acceleration of about 20 g. Therefore, the total cross sectional area $A_t$ of the connecting cables can be determined from the equation $\sigma A_t=F_t$ where $F_t$=total tension in the cables$=\sqrt{2}\times15{,}179{,}000\times20\times9.81\text{N}=4.212\times10^9$N. Hence, since $\sigma=1.4\times10^{10}$N/m$^2$, it follows that $A_t=0.301$ m$^2$. Therefore, since the length of each cable is equal to $\sqrt{2}R=14{,}142$ m, the total mass of the cables will be approximately 9,190,000 kg. If each cable has a diameter of 5.5 mm, there would be 12,566 individual cables attached all around the inside perimeter of the airfoil at 5 m Intervals. This would uniformly distribute the tremendous propulsive thrust generated by the coil thereby preventing coil deformation. Assuming that the aeroshell 82 and all its internal components (which is connected to the cables) has a total mass of 10,000 kg, the actual payload mass $m_p=m_t=m_c-10{,}200{,}000$ kg$=6{,}000{,}000$ kg (13,230,000 lbs or 6,600 tons). This payload mass is 200 times greater than the 30,000 kg that the U.S. Space Shuttle could deliver to the same orbit.

The comparison of the magnetic system to the prior art is even more striking when the cost of launching payloads is compared. For example, the cost of delivering payloads to orbit in the Space Shuttle is \$2,000/lb. Hence, if the above payload mass were delivered to orbit using the Space Shuttle, the total delivery cost would be 13,230,000 lbs$\times$(\$2,000/lb)=\$26.5 billion. However, since the magnetic propulsion system generates its own electrical energy, the cost of delivering this gigantic payload to orbit by the magnetic system is zero. The magnetic propulsion system will also be much more reliable than any prior art launch vehicle because the engine has no moving parts and burns no combustible fuel. (In fact, there is no "engine".)

There is another economic aspect which will have a profound impact on the SDI Program. The current planning for SDI payloads calls for 50 million pounds to be orbited at a total launch cost of \$130 billion. The magnetic propulsion system envisioned herein will be capable of delivering all of this payload in a single launch at zero cost. (A propulsion coil with $\gamma=100{,}000$ and $R_2=16{,}000$ m would be sufficient.) Moreover, the propulsion system will also be capable of transporting extremely large and bulky SDI payloads that could be completely assembled and tested on the ground before being transported to orbit as a single unit. This would eliminate the very tedious, costly, and time consuming process of having to assemble large SDI systems in orbit by transporting small components piece by piece.

The magnetic propulsion system could easily launch a huge fully assembled space station that is even larger and more elaborate than the giant toroidal design illustrated in Arther C. Clarke's famous science fiction novel "2001 Space Odyssey"—fully manned with a crew of several hundred. In these ultra large payloads, an outer ablative protective jacket could be mounted around the payload that is designed to protect the payload while traversing through the atmosphere at high speed. (It would not have to be enclosed in any separate structure while being transported to orbit.)

Table 1 is a detailed computer simulation of the magnetic propulsion system launching a total launch mass $m_t$=20,443,000 kg directly into orbit corresponding to the example given above. The various flight parameters described in the table are:

h=altitude (km)
T=elapsed time from lift off (sec)
$\phi$=flight path angle (from vertical, deg)
s=distance traveled along ascent trajectory (km)
F=propulsive thrust ($10^9$N)
P=propulsive power (GW)
a=acceleration (g)
V=velocity (relative to launch site km/sec)

TABLE 1

Flight Parameters Of A 20 km Diameter Magnetic Propulsion Coil Accelerating A Launch Mass Of 20,443,000 kg To A 269.1 km High Circular Orbit

| h | T | $\phi$ | s | F | P | a | V |
|---|---|---|---|---|---|---|---|
| 10.0 | 22.91 | 10.35 | 10.08 | 1.767 | 1479 | 7.83 | 0.837 |
| 20.0 | 36.56 | 14.75 | 20.33 | 3.124 | 5415 | 14.61 | 1.733 |
| 30.0 | 47.86 | 18.21 | 30.77 | 3.941 | 10018 | 18.70 | 2.542 |
| 40.0 | 58.38 | 21.19 | 41.39 | 4.289 | 13951 | 20.45 | 3.253 |
| 50.0 | 68.75 | 23.89 | 52.22 | 4.308 | 16662 | 20.57 | 3.868 |
| 60.0 | 79.34 | 26.39 | 63.27 | 4.122 | 18129 | 19.66 | 4.398 |
| 70.0 | 90.37 | 28.75 | 74.56 | 3.820 | 18533 | 18.17 | 4.852 |
| 80.0 | 102.04 | 31.02 | 86.09 | 3.459 | 18125 | 16.39 | 5.240 |
| 90.0 | 114.52 | 33.21 | 97.90 | 3.079 | 17154 | 14.52 | 5.572 |
| 100.0 | 127.99 | 35.35 | 110.00 | 2.704 | 15833 | 12.67 | 5.855 |
| 110.0 | 142.65 | 37.46 | 122.43 | 2.350 | 14325 | 10.93 | 6.095 |
| 120.0 | 158.69 | 39.55 | 135.21 | 2.026 | 12765 | 9.33 | 6.301 |
| 130.0 | 176.34 | 41.63 | 148.38 | 1.735 | 11234 | 7.90 | 6.475 |
| 140.0 | 195.86 | 43.71 | 161.98 | 1.477 | 9787 | 6.64 | 6.624 |
| 150.0 | 217.63 | 45.81 | 176.07 | 1.252 | 8454 | 5.48 | 6.750 |
| 160.0 | 241.95 | 47.94 | 190.69 | 1.057 | 7248 | 4.60 | 6.857 |
| 170.0 | 269.18 | 50.12 | 205.96 | 0.889 | 6175 | 3.79 | 6.949 |
| 180.0 | 299.93 | 52.35 | 221.93 | 0.744 | 5226 | 3.10 | 7.026 |
| 190.0 | 334.89 | 54.67 | 238.74 | 0.619 | 4391 | 2.51 | 7.092 |
| 200.0 | 375.01 | 57.09 | 256.58 | 0.512 | 3663 | 2.01 | 7.149 |
| 210.0 | 421.47 | 59.65 | 275.65 | 0.420 | 3023 | 1.59 | 7.196 |
| 220.0 | 476.05 | 62.39 | 296.28 | 0.340 | 2463 | 1.23 | 7.236 |
| 230.0 | 541.44 | 65.39 | 319.01 | 0.271 | 1968 | 0.93 | 7.270 |
| 240.0 | 622.00 | 68.78 | 344.71 | 0.209 | 1524 | 0.68 | 7.299 |
| 250.0 | 725.60 | 72.78 | 375.08 | 0.155 | 1131 | 0.47 | 7.323 |
| 260.0 | 873.74 | 78.06 | 414.80 | 0.094 | 693 | 0.26 | 7.343 |
| 269.1 | 1239.94 | 90.00 | 501.63 | 0.000 | 0.26 | 0.00 | 7.358 |

Figure 22:
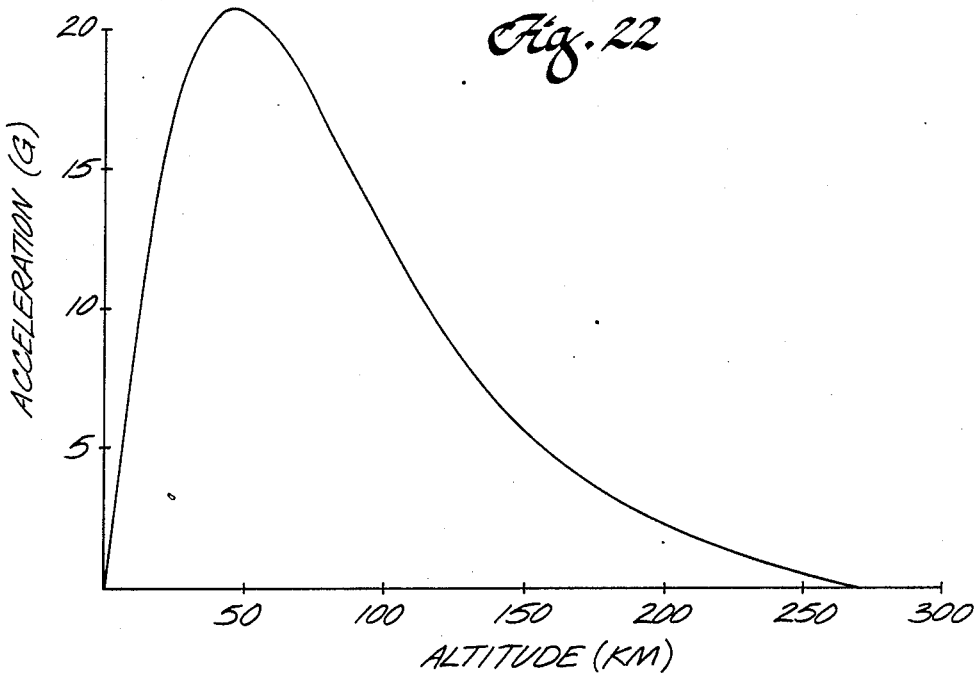
FIG. 22 is a graph of acceleration versus altitude of a 20 km diameter magnetically propelled dipole coil accelerating a total launch mass of 20,443,000 kg directly to a 269.1 km high resonant parking orbit.

This table clearly demonstrates that the magnetic propulsion system will propel the payload out of the atmosphere very rapidly with a nearly vertical ascent trajectory. For example, 22.91 seconds after launch, the coil will be at an altitude of 10 km (32,808 ft) and moving nearly vertically upward with a velocity of 0.837 km/sec (Mach 2.70). At 36.56 seconds after launch, the coil will be at 20 km (65,618 ft) and moving at 1.733 km/sec (Mach 5.94). The coil essentially leaves the atmosphere 47.86 seconds after launch with a velocity of 2.542 km/sec (Mach 8.32) at an altitude of 30 km (98.425 ft). Thus, relatively little initial magnetic launch energy is lost by aerodynamic drag while traversing through the atmosphere. The system is therefore able to convert initial electrical energy into orbital energy with an efficiency of nearly 100%. FIG. 22 is a graph of acceleration (g) versus altitude h (km) corresponding to this example.

Perhaps the most spectacular parameters in the table are propulsive thrust F and propulsive power P. At an altitude of 50 km, the propulsive force is 4,308,000,000N or 968,530,000 lbs which is more than 130 times greater than the maximum lift off thrust generated by the giant Saturn V Apollo launch vehicle. At an altitude of 70 km, the propulsive power P reaches 18,533 GW which is more than 60 times greater than the total electric power generating capacity of the entire United States. This enormous power is being transmitted to the coil inductively via the magnetic field and converted into propulsive thrust with an efficiency of 100%.

It is also interesting to note that although the propulsive thrust is very high during the initial portion of the ascent trajectory, it decreases to very low values when approaching orbital altitude This operating characteristic is opposite prior art chemical launch vehicles where the propulsive thrust steadily increases by burning propellant. The table shows that between 22 and 176 seconds after launch, the acceleration exceeds 7 g. For manned payloads, this high acceleration period can be reduced by utilizing the coil's switching circuits to reverse a portion of the coil's total current. This will decrease the coil's effective magnetic dipole moment thereby reducing propulsive thrust. After the coil reaches a sufficiently high altitude, the switching circuits can set all the current moving in the same direction for maximum thrust. There would be no decrease in operating efficiency when using the switching circuits to reduce and to increase the coil's acceleration because the conversion of electrical energy to kinetic energy is essentially 100% efficient.

If the acceleration is reduced, the stress acting on the connecting cables will be reduced. This would enable their total mass to be decreased, which would allow the payload mass to be increased. For example, in the case described above, if the peak acceleration were reduced from 20 g down to 10 g, the cable mass could be reduced by 4,600,000 kg. A large portion of this mass savings could be used for increasing the payload mass. (A detailed analysis of this situation is beyond the intended scope of this disclosure.)

The entire magnetic propulsion space transportation complex would cover a circular region approximately 250 miles in diameter. Although such a region may appear unreasonably large, there are many government owned regions in the western United States that are much larger. (For example, 85% of the total land area of Nevada is government property.) The proposed system could be constructed on such land by a private company that leases the land from the government in exchange for providing the government with very cheap transportation to orbit. The complex could be operated as a commercial space transportation company that could provide cheap space transportation for private individuals and corporations. The proposed system would not only provide all space transportation for the United States (and other Western Democratic countries) but it would also be capable of generating all electric power consumed by the United States and many other countries. Thus, the potential economic and scientific benefits that such a complex could bring to the United States is almost beyond imagination.

Many other embodiments of the invention are possible. A much smaller embodiment could be constructed for providing low cost transportation for unmanned payloads. For example, suppose 16 coaxial field coils are constructed with radii of 20 km, 22 km, 24 km, . . . , 50 km, each carrying a current of $2\times10^9$ amp. The values of $S_1$ and $S_2$ for this coil distribution would be $4.9349\times10^{-4}$ and $1.0404\times10^{-6}$ respectively. Hence, $S_1-S_2=4.9245\times10^{-4}m^{-1}$. The minimum aspect ratio $\gamma_m$ of the propulsion coil forth is coil distribution would be 2991 which is obtained by solving equation (28) by setting $m_t/m_c=1$. Therefore, any propulsion coil with an aspect ratio $\gamma>2991$ will be able to accelerate payloads into orbit for this coil distribution.

Suppose that the propulsion dipole has an aspect ratio $\gamma=10{,}000$. The mass ratio $m_t/m_c$ corresponding to this aspect ratio, which is determined by equation (28), is 3.147. If the coil's major radius $R=1{,}000$ m, then its minor radius $r=R/\gamma=0.1$ m and its mass $m_c=2\pi R\pi r_2\rho=426{,}367$ kg. Consequently, the total launch mass $m_t=1{,}341{,}615$ kg. The airfoil mass and its internal components (minus the propulsion coil) will be about 0.25 $m_c=106{,}592$ kg. Hence, the total mass that must be accelerated by the connecting cables is about 808,656 kg. The quantity RJ, which is determined from equation (13), is $6.502\times10^{11}$ amp/m.

Figure 23:
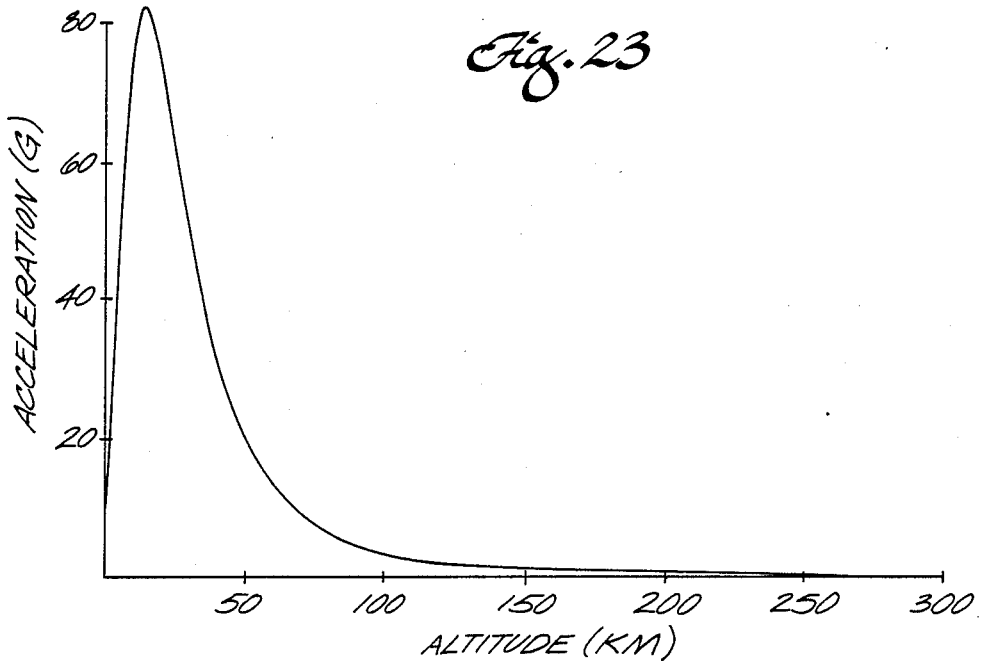
FIG. 23 is a graph of acceleration versus altitude of a 2 km diameter propulsion coil accelerating a total launch mass of 1,342,000 kg to orbit corresponding to an alternative field coil distribution.

The coil's thrust to weight ratio T/W can be determined by equation (19) by dividing the right side of this equation by the mass ratio $m_t/m_c=3.147$. The resulting thrust to weight ratio is also equal to the coil's acceleration in g's. A graph of this acceleration versus altitude h (km) is given in FIG. 23. It is evident from this graph that the maximum acceleration will be about 82 g and will occur at an altitude of about 14 km (45,900 ft).

The total cross sectional area $A_t$ of the connecting cables can be determined from the equation $\sigma A_t=\sqrt{2}\,808656\times82\times9.81N=9.199\times10^8N$. Hence, $A_t=0.0657$ $m^2$. Since the length of the cables is $\sqrt{2}\,R=1{,}414$ m, the total cable mass will be about 200,700 kg. Assuming an aeroshell mass of 2,000 kg the total payload mass $m_p$ will be about 606,000 kg. This payload mass is over 20 times greater than could be delivered by the Space Shuttle. Although a maximum acceleration of 82 g is too high for manned payloads, it is not too high for non-manned payloads.

Since small embodiments of the invention will generate very high accelerations, it is important to understand that there will be some upper limit on acceleration which cannot be exceeded This limit arises from the fact that the propulsion dipole accelerates the payload mass by the connecting cables, which also has mass. If the acceleration is very high, the cables must have sufficient tensil strength to avoid breaking under the high acceleration loads. Thus, the mass of the cables must increase with acceleration. Since the total launch mass and dipole mass are fixed quantities, any increase in cable mass results in an equal decrease in payload mass. Thus, there is some maximum acceleration where the payload mass is zero, and the coil mass is maximum. Let $a_m$ denote this maximum acceleration in g units. Let $M_m$ denote the maximum cable mass (corresponding to zero Payload mass) with a total cross sectional area $A_m$. Hence, since the semi vertex angle of the connecting cables (FIG. 6) is always 45° to minimize the cable mass, it follows that the maximum possible tension in the cables is equal to $\sigma A_m=\sqrt{2}M_m g\ a_m$. If R denotes the coil radius, the length of the cables is equal to $\sqrt{2}$ R. Hence, the cable mass $M_m=A_m\sqrt{2}\ R\rho$. Consequently, it follows from these two equations that $$a_m=\frac{\sigma}{2gR\rho} \tag{30}$$

Since R is the only variable parameter in this equation, it follows that the maximum possible acceleration $a_m$ is a function of only the radius R of the propulsion dipole. A graph of this maximum acceleration $a_m$ versus R is given in FIG. 24. This graph is useful in contemplating various field coil distributions and propulsion coil radii since the resulting maximum acceleration should always be well below $a_m$ in order to maximize payload mass. The maximum acceleration $a_m$ corresponding to a coil radius $R=1{,}000$ m is 330.35 g. Since this is significantly greater than 82 g maximum acceleration for the numerical example given above, the required cable mass $M_c$ is relatively low. In general, the required cable mass $M_c=(a/a_m)(m_t-1.25\ m_c)$ where a is equal to the actual maximum acceleration. The payload mass $M_p=(m_t=1.25\ m_c)\ [1-(a/a_m)]$.

It should be emphasized that the ground to orbit propulsion concept and operating method disclosed herein is radically different from prior art propulsion concepts that also use magnetic forces generated by current carrying coils to generate propulsive thrust. In the prior art systems, (which are called "mass drivers" or "coaxial electromagnetic accelerators") the moving propulsion coil (which is mounted around the payload) is very small, usually only a few centimeters in diameter, and moves through an evacuated tube surrounded by a plurality of identical coaxial field coils mounted at various intervals along the tube. The field coils are exited (i.e., pulsed with a current surge) in a sequence timed with the moving coil to generate a travelling magnetic field. Thus, the moving coil is accelerated by a series of relatively small incremental steps as it passes through each field coil. These prior art systems are very complicated electronically (because of the required timing circuits) and can only accelerate very small payloads that are restricted in size by the diameter of the evacuated accelerating tube. Moreover, if the moving coil makes contact with the inside walls of the tube, it could cause the system to disintegrate because of the very high speeds involved. Since the tube must be several kilometers long in order to reduce acceleration loads, it must remain stationary. Thus, the azimuth angle of the launch trajectory always remains constant which makes it impossible to vary the inclination angle of the injection orbit without using another propulsion system. These are fundamental problems inherent in prior art magnetic propulsion systems that cannot be circumvented. Thus, the practical utility of prior art ground to orbit launch systems using magnetic forces is severely limited. A good technical description of this prior art can be found in the following papers: "Basic Principles Of Coaxial Launch Technology," *IEEE Transactions On Magnetics*, Vol. MAG-20, No. 2, March 1984, pp. 227–230, by H. Kolm and P. Mongeau; and "An Alternative Launching Medium," *IEEE "Spectrum*, April 1982, pp. 30–36, by H. Kolm and P. Mongeau.

The propulsion concept disclosed herein generates its magnetic propulsive force by a plurality of much larger nearly concentric field coils, with increasing diameters extending to many kilometers, that generate constant fields and act simultaneously to generate a giant static magnetic field in the open atmosphere that extends all the way to orbital altitude. The propulsion coil, which is also giant size, several kilometers in diameter, is charged with current near the center of this field and propelled by an enormous, magnetic repulsive force that continuously accelerates the coil (along with its attached payload) through the atmosphere all the way to the desired orbit. Thus, this concept is radically different from anything previously contemplated in the prior art—even in science fiction. The coil can be accelerated to orbit with any desired azimuth angle by simply following along a line of magnetic induction generated by the field coils that has the desired azimuth angle. However, the most important feature of this magnetic ground to orbit propulsion concept is the fact that it will be capable of launching payloads (at nearly zero cost) that, for all practical purposes, can have unlimited mass and unlimited physical dimensions. This is a complete and utter impossibility within the prior art of space travel and will have truly revolutionary implications. For example, the system will be capable of transporting giant size, completely assembled toroidal space stations several hundred meters in diameter containing several hundred occupants with a mass of thousands of tons. It could also be used to transport huge, completely assembled self refueling space based interorbital/interplanetary vehicles operating under the generalized theory of rocket propulsion to transport hundreds of passengers at very low cost on high speed interplanetary trajectories throughout the entire solar system. Giant spheres could be launched containing tens of thousands of passengers. Since the system is so simple and requires very few moving parts, an accidental crash would be virtually impossible.

The proposed system would also enable the construction of huge interstellar vehicles propelled by interstellar ramjet systems. These propulsion systems operate by scooping up ions many kilometers in front of the vehicle and channeling them into a nuclear fusion reactor by magnetic forces generated by a plurality of giant superconducting dipole coils many kilometers in diameter. See "Magnetic Intake Limitations On Interstellar Rarjets," *Astronautica Acta,* Vol. 18, pp. 1–10, by A. R. Martin. Although such vehicles may be theoretically possible, they could probably never be constructed using prior art ground to orbit transportation systems because the required dipole ion scoops are too large (by several orders of magnitude). However, with the magnetically propelled ground to orbit transportation system disclosed herein, completely assembled superconducting dipole ion scoops exceeding 50 km in diameter could propel themselves into orbit using the field coils for propulsion (taking the completely assembled vehicle with them).

In some respects, the ground to orbit propulsion concept disclosed herein can be viewed as a huge vortex field defining a corridor into space through which unlimited mass can be catapulted (and returned) essentially at zero cost. Although its operating principles are uniquely simple, it is beyond even science fiction propulsion systems since huge payloads of almost unlimited mass can be levitated from the earth's surface and accelerated upward in complete silence with a propulsion device so unlike prior art systems it is hard to imagine. (The cross section of the airfoil around the Propulsion coil is so small it could not be seen from the launch point.) Perhaps the closest science fiction propulsion system that it could be compared to is the one described in H. G. Wells' 1901 novel *First Men in the Moon.* In this book Wells describes a substance called "Cavorite" which has the unique ability to block the force of gravity by creating a "gravitational shadow". In one sense, the superconducting field coils can be compared to Wells' "Cavorite" since it creates a local area on the earth's surface which, when employing a similar device (i.e., a superconducting propulsion coil) enables huge objects to be levitated against gravity and repelled away from the earth by enormous propulsive force. But this device is even more potent than Cavorite since the propulsive forces will be many times greater than those generated by Cavorite (which were gravitational). Although this disclosure is not intended to be non technical, it is perhaps appropriate to emphasize the fact that the invention is not like prior art ground to orbit propulsion systems in that it will provide a capability for transporting payloads to orbit on a scale never before imagined.

It should also be pointed out and emphasized that the construction of the self supporting dipole propulsion coil described above, where thin layers of ceramic superconducting material is vapor deposited directly onto fused silica glass fibers, is not a necessary construction feature in the practice of this invention. The superconducting material can be deposited on some intermediate fiber substrate having high tensil strength $\sigma$ and low density $\rho$ such as carbon fibers. The superconducting tension bearing cable could then be fabricated by embedding the carbon filaments in a matrix of fused silica glass fibers as described in my previously mentioned U.S. Pat. No. 4,078,747. The mass ratio $m_f/m_c$ of a propulsion coil (which can be viewed as a coefficient of performance for the coil) given by equation (28) shows that this ratio is proportional to the square root of $\sigma$ divided by $\rho$. Thus, $\sigma$ is not a critical design parameter for increasing the coil's performance, as is its density $\rho$. For example. if the coil were constructed with the fabrication technique described in my U.S. Pat. No. 4,078,747 where $\sigma=1.048\times10^{10}N/m^2$ and $\rho=1959$ $kg/m^3$, the coil's mass ratio would decrease by only 5%.

It should also be pointed out that the magnetic field generated by the field coils may be increased by the presence of underground deposits of iron ore or other natural ferromagnetic substances in the earth near the field coils.

Many other embodiments of the invention are possible in addition to those described above. For example, the superconducting propulsion dipole could be replaced by a plurality of coaxial superconducting dipole coils 214 as shown by the plan view of FIG. 25. These coils 214 would be mounted in circular hypersonic airfoils 216 that have a construction similar to that described above for a single propulsion dipole. These multiple propulsion dipoles could be joined together by radial fin structures 218, that maintain the relative spaced apart positions of the dipoles. (These structures 218 could also be replaced with cables in order to reduce the mass of the propulsion system.) They could also be equipped with switching circuits, identical to that described for the single coil propulsion system, for reversing a portion of the current. As an alternative to this current reversing system, each particular dipole coil 214 can be constructed such that all of its current is moving in the same direction but equipped with switches 220 and current carrying cables 222 that enable current in one dipole coil to be transferred into an adjacent dipole coil. This will enable the total magnetic dipole moment of the system to be changed during the acceleration process in order to reduce the high propulsive thrust during the initial portion of the ascent trajectory, and increase the thrust during the last portion of the ascent trajectory in order to obtain a more uniform acceleration profile over the entire ascent trajectory. For example, at the moment of launch, all the dipole coils are charged with maximum current, but some dipoles have their current moving in a direction opposite that in most dipoles. This will reduce the net magnetic dipole moment at launch. After the system is launched and passes the point of maximum acceleration, the coils having negative dipole moments can be discharged into those having positive dipole moments thereby increasing the net dipole moment of the system and hence, increasing the propulsive thrust.

It should be also pointed out and emphasized that the dive brakes 54 (FIGS. 3,5) mounted on the airfoil 38 can be designed to generated substantial aerodynamic drag when fully extended all around the airfoil. This drag could be used to reduce the coil's very high acceleration along the initial portion of the ascent trajectory a altitudes below 70 km within the earth's atmosphere (see Table 1). This would enable the propulsion coil to be operated at its maximum dipole moment during the ascent while keeping the maximum acceleration below 7 g for manned payloads As the altitude increases beyond 50 km, the magnetic propulsion decreases, but so does the drag. Hence, a nearly constant acceleration (of between 6 g and 7 g) could be maintained over the initial portion of the ascent trajectory through the atmosphere without changing the magnetic dipole moment of the propulsion coil by means of switching circuits Additional drag could be generated by dive brakes mounted on the aeroshell, and possibly, by deploying a small drogue chute from the payload.

In another embodiment, the field coils could have non circular geometries. They could, in fact, be designed as relatively long narrow loops pointing eastward.

Still another embodiment could be designed so that the magnetic propulsion system operates only as a first stage accelerating system. For example, in this embodiment, a propulsion coil could accelerate a reusable shuttle type aerospace plane equipped with a conventional rocket propulsion system, to Mach 10 at an altitude of 50 km. At this point the aerospace plane could be released from the propulsion coil and accelerated to orbit using its own rocket propulsion system.

Other embodiments could be used for propelling payloads from the surface of other celestial bodies such as the moon. It would be ideal for lunar operation because of the reduced gravitational field. Thus, relatively small field coils could be used for accelerating enormous payloads into orbit. It would be much more practical than the electromagnetic mass drivers previously proposed because of its simplicity, ease of construction, and because it could be used to launch very large manned payloads with dimensions many orders of magnitude greater than could fit inside a small "propulsion bucket" of a lunar mass driver. The payloads could also be launched with any desired launch azimuth to obtain orbits with any desired inclination. Prior art electromagnetic mass drivers proposed for lunar operation are restricted to only one launch azimuth. (See "The Colonization of Space," *Physics Today,* Vol. 27, Sept. 1974, pp. 32–40, by G. O'Neill.)

The moon may provide an ideal base for launching huge, completely assembled toroidal shaped interplanetary vessels exceeding one kilometer in diameter and capable of carrying thousands of passengers designed for cruising throughout the solar system propelled by gravity propulsion from planet to planet (See, "Gravity Thrust and Interplanetary Transportation Networks," *Use of Space Systems for Planetary Geology and Geophysics,* Science and Technology Series, Vol. 17, American Astronautical Society, 1968, by M. Minovitch.) For example, a 50,000 ton vessel could be catapulted from the lunar surface directly onto an interplanetary escape trajectory by a giant magnetic propulsion coil several kilometers in diameter and would move along a free-fall trajectory throughout the solar system from one planet to another without ever landing. Space voyagers wishing to transfer from one planet to a certain other planet (or satellite thereof) simply "catches a ride" on the next space liner that passes by on its way to the desired destination. By propelling the vessel with gravitational propulsion it does not have to be burdened with conventional rocket propulsion systems and the huge quantities of propellant required to operate them. Under the principle of gravitational propulsion, the propulsive energy required to change the interplanetary trajectory relative to the sun in order to enable it to encounter the next planet is obtained by harnessing the vast orbital energy of the previous planet via pre-determined gravitational interactions. Unlike the thrust forces generated by conventional onboard rocket engines operating by the reaction principle, the forces generated by gravitational propulsion increase automatically with vehicle mass as prescribed by the equivalence principle. Thus, once a payload is launched onto the first leg of its interplanetary trajectory, it doesn't matter if its mass if 50 kg or 50,000 tons. The present invention is ideally suited for taking advantage of the enormous potential of gravity propulsion because it will be capable of catapulting extremely massive payloads, such as the above described space liners, onto never ending gravity propelled interplanetary trajectories.

From the foregoing description, it will thus be evident that the present invention provides a vastly improved method for propelling payloads from the earth's surface into orbit for achieving economical space transportation. As various changes and modifications can be made in the above system and operating method without departing from the spirit or scope of the invention, it is intended that all matter contained in the above description or shown in the accompanying drawings, should be interpreted as illustrative an not in a limiting sense.

What is claimed is:

1. A method for accelerating a body to high velocities comprising the steps of:

mounting a plurality of stationary spaced apart superconducting field coils with increasing radii with approximately concentric and coplanar relative positions on mounting structures;

charging said field coils with electric current thereby creating a primary magnetic field represented by the vector summation of magnetic fields generate by the individual field coils charged with said electric current;

charging a movable superconducting propulsion coil with current so as to create a secondary magnetic field opposing said primary magnetic field;

attaching said body to said superconducting propulsion coil; and accelerating said body by magnetic repulsive forces exerted on said propulsion coil by said field coils acting simultaneously.

2. A method as set forth in claim 1 wherein said propulsion coil is a self supporting dipole with an aspect ratio exceeding 100.

3. A method as set forth in claim 1 further comprising the step of varying said repulsive forces acting on said propulsion coil by changing the direction of a portion of said current flowing around said propulsion coil.

4. A method as set forth in claim 1 further comprising the step of constructing said stationary and said movable superconducting coils with superconducting material having critical temperatures above 77° K.

5. A method as set forth in claim 1 further comprising the step of mounting said field coils beneath the earth's surface in coaxial planes approximately parallel to the earth's surface such that said primary magnetic field extends into space above the earth's surface.

6. A method as set forth in claim 5 wherein said accelerating step comprises the step of accelerating said body in an upward direction away from the earth's surface.

7. A method as set forth in claim 6 further comprising the step of mounting said movable superconducting propulsion coil inside an aerodynamically streamlined housing.

8. A method as set forth in claim 7 further comprising the step of mounting movable aerodynamic control surfaces on said housing for guiding said coil through the earth's atmosphere.

9. A method as set forth in claim 7 further comprising the step of maintaining said propulsion coil at cryogenic temperature by cryogenic cooling means mounted inside said housing.

10. An apparatus for accelerating a body to high velocities comprising:

a plurality of stationary superconducting field coils with increasing radii;

means for mounting said field coils with approximately concentric and coplanar relative positions;

means for charging said superconducting field coils with electric current thereby generating a primary magnetic field represented by the vector suction of magnetic fields generated by the individual field coils charged with said electric current;

a movable superconducting propulsion coil;

means for charging said movable superconducting propulsion coil with electric current so as to generate a secondary magnetic field that opposes said primary magnetic field generated by said stationary superconducting field coils;

means for attaching said body to said movable superconducting propulsion coil; and means for launching said body such that said body is accelerated away from said field coils by magnetic repulsive forces exerted on said propulsion coil by said field coils acting simultaneously.

11. An apparatus as set forth in claim 10 wherein said propulsion coil is a self supporting dipole with an aspect ratio exceeding 100.

12. An apparatus as set forth in claim 10 wherein said propulsion coil comprises a plurality of current carrying loops and switching means for reversing the direction of current flow in said loops for varying said magnetic repulsive forces.

13. An apparatus as set forth in claim 10 wherein said field coils and said propulsion coil are constructed with superconducting material having a critical temperature above 77° K.

14. An apparatus as set forth in claim 10 wherein said means for mounting said field coils comprises:

a plurality of circular underground tunnels; and means for mounting said field coils inside said tunnels in parallel planes approximately parallel to the earth's surface such that said primary magnetic field extends into space above the earth's surface.

15. An apparatus as set forth in claim 14 wherein said body is accelerated in an upward direction away from the earth's surface.

16. An apparatus as set forth in claim 15 further comprising:

a circular airfoil; and means for mounting said movable superconducting coil inside said airfoil.

17. An apparatus as set forth in claim 16 further comprising:

movable aerodynamic control surfaces mounted on said airfoil; and means for moving said control surfaces such that said airfoil can be guided by aerodynamic forces while traversing through the earth's atmosphere.

18. An apparatus as set forth in claim 16 further comprising cryogenic cooling means mounted inside said airfoil for maintaining said movable superconducting coil at cryogenic temperature.

* * * * *